US011339025B1

(12) United States Patent
Jackson et al.

(10) Patent No.: US 11,339,025 B1
(45) Date of Patent: May 24, 2022

(54) TUBULAR WINDING AND PROCESS FOR THE FIBRE ARTS

(71) Applicant: SPINRITE INC., Listowel (CA)

(72) Inventors: Julia Scarlet Jackson, Listowel (CA); Amber Monique Ann Groen, Listowel (CA); Ruhi Arasan, Usak (TR); Atakan Arasan, Usak (TR); Tolga Arasan, Usak (TR)

(73) Assignee: SPINRITE INC., Listowel (CA)

( * ) Notice: Subject to any disclaimer, the term of this patent is extended or adjusted under 35 U.S.C. 154(b) by 0 days.

(21) Appl. No.: 17/525,428

(22) Filed: Nov. 12, 2021

Related U.S. Application Data

(60) Provisional application No. 63/113,081, filed on Nov. 12, 2020.

(51) Int. Cl.
*B65H 54/14* (2006.01)
*B65H 55/02* (2006.01)
*B65H 55/04* (2006.01)

(52) U.S. Cl.
CPC ..... *B65H 54/14* (2013.01); *B65H 55/02* (2013.01); *B65H 55/04* (2013.01); *B65H 2701/31* (2013.01)

(58) Field of Classification Search
CPC ..... B65H 54/14; B65H 55/02; B65H 55/04; B65H 2701/31
See application file for complete search history.

(56) References Cited

U.S. PATENT DOCUMENTS 674,114 A 5/1901 Cree
903,643 A * 11/1908 Wardwell ..... B65H 55/04 242/175
2,205,385 A * 6/1940 Abbott ..... B65H 54/10 242/175
2,380,038 A * 7/1945 Garrott ..... B65H 55/04 242/176
4,957,344 A * 9/1990 Chesler ..... G02B 6/4457 242/177
5,104,053 A 4/1992 Bradshaw
5,161,208 A * 11/1992 Christie ..... B65H 55/00 242/170
5,221,060 A * 6/1993 Couvillion ..... B65H 55/04 242/920

FOREIGN PATENT DOCUMENTS

CH 247676 A 3/1947
GB 510981 A 8/1939
GB 2564661 A * 1/2019 ..... B65H 54/10

OTHER PUBLICATIONS

International Application No. PCT/IB2021/060521, International Search Report dated Feb. 4, 2022, 2 pages.

* cited by examiner

*Primary Examiner* — William E Dondero
(74) *Attorney, Agent, or Firm* — Cozen O'Connor

(57) ABSTRACT

A method of winding fibre to create a tubular winding by using at least three different motions to create interlocking segments. The interlocking segments may have at least one fibre parameter that is different, such as colour. The tubular winding may be bent into a curved shape so that a portion of each of the segments is visible.

20 Claims, 12 Drawing Sheets

TUBULAR WINDING AND PROCESS FOR THE FIBRE ARTS

CROSS-REFERENCE TO RELATED APPLICATIONS

This application claims priority to U.S. Provisional Application No. 63/113,081, filed Nov. 12, 2020, which is incorporated herein by reference.

TECHNICAL FIELD OF THE INVENTION

The present invention relates to the technical field of spinning and in particular to processes for building up fibre packaging in the form a tubular winding.

BACKGROUND

Fibre crafters, no matter what technique, e.g., knitting, crocheting, embroidering, weaving, stitching, sewing, etc., face a common problem that involves knotting or tangling of the fibre prior to or during use. Fibres can be so fine as to be measured in micrometers or quite thick.

Fibres packaged for use in knitting, crocheting, embroidering, and the like are typically wound into a form, commonly referred to as a hank or skein, as a continuous strand of predetermined length. One significant problem with conventional fibre packages is that the fibre tangles easily as it is pulled from the fibre package. This problem must typically be addressed by the consumer, e.g., by winding the skein/hank into a ball shape, prior to use so that the fibre may be continuously drawn from the ball without tangling. As an improvement to the traditional hank/skein, fibre manufacturers developed what is commonly referred to as a pull skein (or a center pull skein), which allowed the consumer to use the fibre without the need to rewind the skein into a ball. The fibre of the pull skein is wound in a plurality of superposed layers, but not in loops around the axis of the skein, with the inner end projecting from the (center of the) package. The outer end of the fibre is fastened to the packaging, and during use the fibre is pulled from the inner/center end.

Although the center pull skein provided convenience to the consumer in that they did not need to rewind the skein into a ball before use, conventional pull skein type windings, whether inner worked or outer worked, have their drawbacks. For example, center pull skeins can be difficult for consumers to find the inner end of the pull skein. Also, when inner worked pull skeins are worked, the loosening of the skein from the center can cause the fibre to tangle and/or knot and/or hollow out the skein, which in turn contributes to more tangling. Additionally, outer-worked pull skeins, such as balls, can travel and/or flip around when worked causing interruptions to the making process. Pull skeins, whether inner- or outer-worked, can cause undesired tension on the fibre when worked if sections are not pre-pulled by the consumer.

In addition, conventional fibre packaging, e.g., skeins, suffer from a lack of structural integrity, which introduces problems relating to shape maintenance and transport issues. Because of, for example, the randomness of the winding and lack of interlocking structures, the skeins are unable to hold up to stacking and packaging and tend to crush and/or unwind. In response, manufacturers are required to use package wrappers to add integrity and to prevent unwinding. The addition of wrappers is costly and adds complication to the manufacturing process.

The disadvantages of the conventional skeins and balls frustrate consumers, waste time, and diminish acceptance of new consumers in the fibre arts. When consumers experience a tangle at the beginning of a project, there is time wasted untangling the skein or ball of material and/or they cut the tangle out and discard the fibre resulting in waste. When consumers experience a tangle while working on a project, at best time is wasted untangling the skein or ball and at worst, the tangle must be cut out creating a join in the fibre resulting in a less than perfect project and frustration and sometimes the need to purchase additional fibre material to replace the cut-out tangle. When consumers are unable to find the end of the fibre in the center of the skein or ball, they use an end on the outside of the skein or ball, which results in constant tugging of the skein or ball, the skein or ball moving away from the person and interrupted work, all sub-optimum experiences.

In addition, with conventional hanks/skeins consumers wishing to work different fibre shades or colours are required to either buy separate skeins for each colour/shade, or to buy a multi-coloured skein, which requires the consumer to work the fibre in the predefined colour sequence or unwind the multi-coloured skein, separate and sever the colours and manually rewind each separate colour into its own hank/skein. And, with the non-discrete configuration of the fibre colours in the conventional multi-coloured packages, the consumer is not able to view all of the colours or assess the configuration of the colours. Stated simply, all of the colours of the package and the percentages of those colours in the package are not on display for the consumer's ease. All of these shortcomings add a high level of frustration to the consumer and increase cost and waste of doing the craft.

In view of the known fibre packages and the disadvantages and/or problems associated therewith, the need exists for improved winding processes that produce fibre packages that provide discrete colour segments for accurately displaying the colour content of the fibre packages; that have better structural integrity; and that reduce or eliminate tangling, all of which are problems of conventional fibre packages. Other beneficial features are also discussed herein.

SUMMARY

This specification describes methods and systems for winding yarns and other natural or artificial fibre for fibre arts into a fibre packages, and in particular to a tubular winding that reduces tangling, loosening, and/or knotting during transport as well as when being worked by a consumer. In addition, the novel tubular winding allows for colour play. Colour play allows manufacturers to package multiple fibre colours in a single package and allows the consumer to start with any colour, by cutting the tubular winding into separate colour segments or leaving them conjoined.

In one embodiment there is a provided a method to buildup a fibre into a tubular winding using three motions, namely a spindle rotation motion, a back and forth motion, and a longitudinal motion. In one embodiment, the back and forth motion may shuffle and travel along the longitudinal motion. In one embodiment, the motions may be separate but are controlled by one or more fibre parameters, colour, weight, type of fibre material. This allows the tubular winding to have one or more segments that are interlocked, but allows for delineation and/or separation based on at least one fibre parameter.

In one embodiment, there is provided a method of building up fibre to a tubular winding having two or more segments having an interlocking configuration, comprising the steps of attaching first fibre end of the fibre to a spindle through a tension guide, rotating the spindle in a fixed plane around an axis, moving the tension guide in a back and forth direction, wherein the throw of the back and forth direction is less than the length of at least one of the two or more segments, and moving the tension guide in a longitudinal direction from one end of the spindle to the opposing end of the spindle, wherein at least a portion of the two or more segments overlaps each other and wherein the two or more segment have at least one fibre parameter that is different. The process may further comprise controlling the rotation of the spindle and/or movement of the tension guide based on one of the at least one fibre parameter. Depending on the control, the throw of the back and forth direction may be substantially constant and/or the movement of the tension guide is substantially constant. In addition, the longitudinal direction may be substantially parallel to the axis. In one embodiment, the at least one fibre parameter may be a type of fibre material, fibre diameter, or colour of fibre. In one embodiment, the fibre is continuous and may have differently colour portions. In one embodiment, the method may also use a core material, e.g., a transparent thermoplastic material. The method may comprise attaching a core material having opposing ends to both end regions of the spindle, removing the tubular winding together the core material from the spindle, and connecting the opposing ends of the core material to form the tubular winding into a curved shape.

In one embodiment, there is provided a method of building up fibre to a tubular winding having two or more segments having an interlocking configuration, comprising the steps of attaching first fibre end of the fibre to a support disc on a spindle through a tension guide; rotating the spindle in a fixed plane around an axis; moving the tension guide in a back and forth direction, wherein the throw of the back and forth direction is less than the length of at least one of the two or more segments; and moving the support disc in a longitudinal direction from one end of the spindle to the opposing end of the spindle, wherein at least a portion of the two or more segments overlaps each other and wherein the two or more segment have at least one fibre parameter that is different.

In one embodiment, there is provided a tubular winding comprising a fibre comprising a first portion having a first fibre parameter and second portion having a second fibre parameter, wherein the first fibre parameter is different from the second fibre parameter; a first segment comprising the first portion having a first fibre parameter, wherein the first segment comprises a first end region, first base region and a first tip region; and a second segment comprising the second portion having a second fibre parameter, wherein the second segment comprises a second overlapping region, second base region and a second tip region. In one embodiment, the second overlapping region covers at least 75% of the first tip region to position the second base region adjacent to the first base region. This allows for a portion of each segment to be visible and another portion to be overlapping. In addition, the first and second segments may be separable. Thus, in one embodiment, both the first base region and the second base region may be visible. In one embodiment, the first and second fibre parameters may comprise a type of fibre material, fibre diameter, or colour of fibre. The first base region may have a diameter that is larger than the first end region or the first tip region or wherein the second base region may have a diameter that is larger than the second end region or the second tip region. In one embodiment, the first tip region or second tip region is tapered. The tubular winding may comprise additional segments, up to 20 segments, with each segment be separable from the adjacent segment. In one embodiment, there is provided a third segment comprising the third portion having a third fibre parameter that is different from either the first fibre parameter or second fibre parameter, wherein the third segment comprises a third overlapping region, third base region and a third end region, wherein the third overlapping region covers at least 75% of the second tip region to position the third base region adjacent to the second base region and wherein both the second base region and the third base region are visible. In one embodiment, the tubular winding may comprise a comprising core material wherein the first segment and second segment, as well as any additional segments, may be wound around the core material. This allows the ends of the core material to be connected to shape the tubular winding into a curved shape. Once curved, the first end region of the first segment may abut the third end region of the third segment.

In one embodiment, there is provided a method of winding natural or artificial fibre to create a tubular winding, the method comprising: feeding a continuous fibre strand from a fibre source through a tension guide, such as a fibre guide; wrapping a beginning end of the continuous fibre around a rotatable spindle with or without a core and aligning a length of the fibre along an axial direction of the spindle; rotating the spindle in a fixed plane while guiding the fibre along the axial direction of the spindle until a predefined amount of the continuous fibre has been wound around the spindle with or without a core material; removing the wound fibre with or without a core material from the spindle; and fastening the ends of the wound fibre to the winding. The winding may then be packaged for sale in various presentation styles, for example circular, longitudinal or horizontal tubes, and/or spiral. Accordingly, in some embodiments the ends of the wound fibre may be fastening together, to the core material, and/or to the packaging.

In one embodiment there is provided a method of producing a tubular winding, the method comprising providing a rotatable spindle, and optionally, a core, extending along a spindle axis; providing a fibre having a first fibre end, a fibre length, and a second fibre end; attaching the first fibre end to the spindle; winding the fibre length about the axis to form the tubular winding having a first end and a second end; connecting the first and second ends of the tubular winding or the first and second ends of the core to form a continuous tubular winding; wherein the winding comprises guiding the fibre in a back and forth motion and axially guiding the fibre at a predetermined rate along the spindle axis; wherein the winding forms a first segment having a first tapered tip and is made from a first colour composition, and wherein the winding forms a second segment having a second tapered tip and is made from a second colour composition and defines a second opening, and wherein the first tapered tip is disposed at least partially inside the second opening.

In alternative methods, the fibre is guided along the axial direction of the spindle by pushing the fibre with a pusher mechanism; moving the fibre guide along the axial direction of the spindle; or moving a bed or frame to which the fibre guide or rotatable spindle is attached or is proximate, along the axial direction of the spindle. In a still further alternative method the spindle is in a fixed position and the fibre guide rotates around the spindle winding the fibre about the fixed spindle. The fibre guide may itself be configured to rotate or a frame to which the fibre guide is attached or adjacent may move to rotate the fibre guide about the fixed spindle.

In addition, the method may further comprise: consecutively winding multiple continuous fibres of different type, diameter, colour, and/or shade along the axial direction of the spindle; and at the transition of each different fibre fixing the end of a previous fibre with a beginning end of a next fibre by knotting, splicing, weaving, gluing, mechanically connecting or taping the ends of the adjacent fibres.

A fibre package comprising a continuous strand of fibre/yarn or other natural or artificial fibre wound in a plurality of adjacent layers which consecutively extend along and surround a core material having first and second ends, wherein the first and second ends of the core material are fastened to each other.

A fibre package comprising a continuous strand of fibre/yarn or other natural or artificial fibre wound in a plurality of adjacent layers which consecutively extend along and surround an axial direction, wherein the beginning and end of the continuous strand of fibre are fastened to each other, the fibre of an adjacent winding, or the winding packaging.

A fibre package comprising a plurality of wound fibre/yarn or other natural or artificial fibre strands consecutively formed along a single axial direction, each wound fibre strand having a different type, diameter, colour, and/or colour shade, wherein at the transition of each different fibre an end of a previous fibre is fixed to a beginning end of a next fibre, each wound fibre or other natural or artificial fibre strand being formed by a continuous strand of fibre or other natural or artificial fibre wound in a plurality of adjacent layers which consecutively extend along and surround the axial direction, and the beginning end of the first continuous strand of fibre and the end of the last continuous strand of fibre are fastened to each other, the fibre of an adjacent winding, or the winding packaging.

BRIEF DESCRIPTION OF THE DRAWINGS

Like reference numbers and designations in the various drawings indicate like elements.

DETAILED DESCRIPTION

Figure 1:
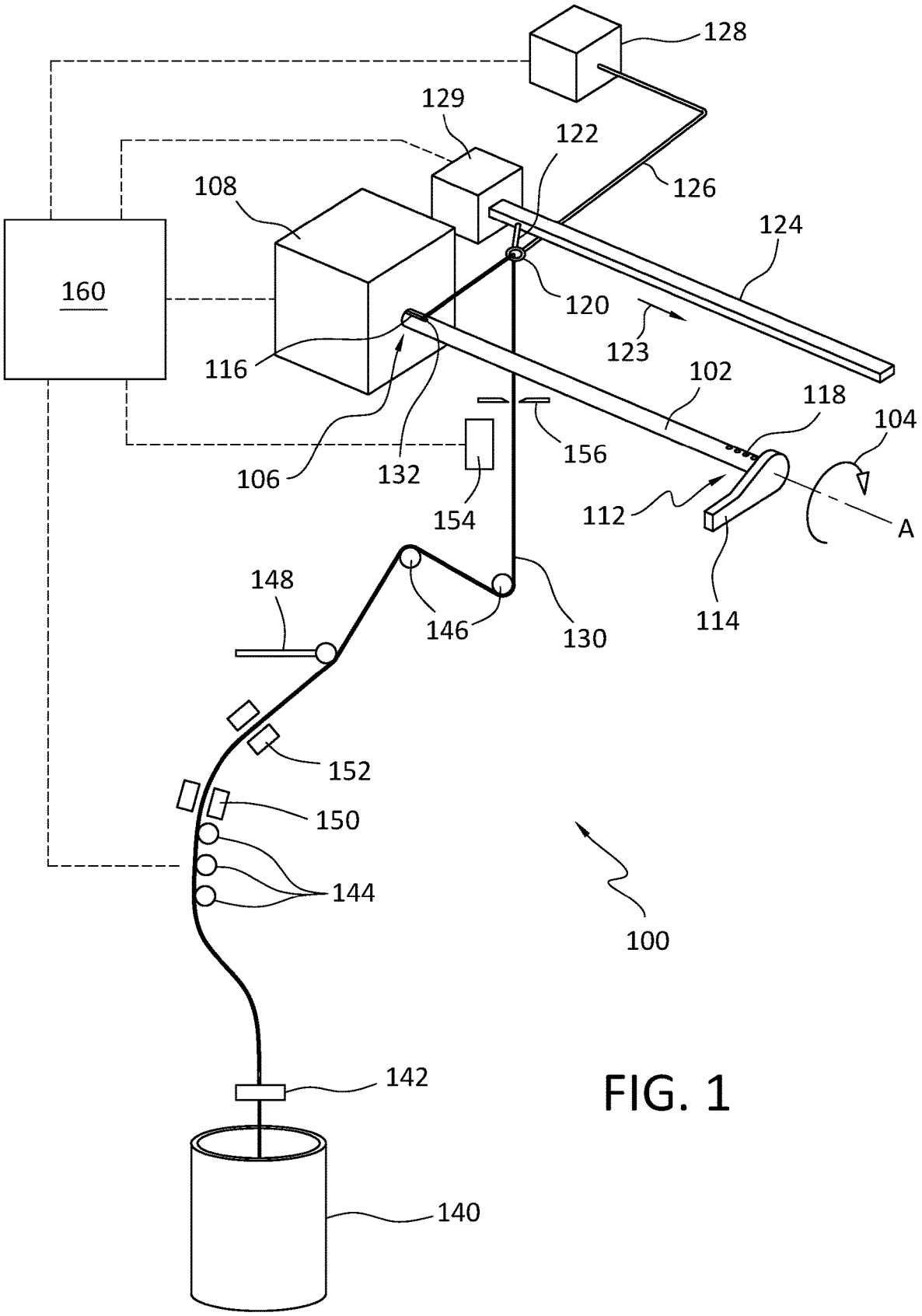
FIG. 1 is a schematic of a winding system in accordance with one embodiment of the invention.

As noted above, conventional fibre packages, e.g., balls or skeins, suffer from, inter alia, the problems of poor structural integrity, colour separation without structural loss, lack of proper colour display, poor aesthetics, and/or undesirable tangling in use. In these conventional fibre packages, the fibre is simply wrapped/layered on top of itself without a common direction, e.g., specifically configured loops, much less an interlocking segment structure, which provides no structural integrity and often then requires packaging to hold its shape. This conventional type of winding leads to inconsistent tension in between layers, which, in turn, results in the fibre traveling in between layers, which leads to significant tangling in use. These packages also suffer from the in-use problems relating to the pulling of the fibre. For example, if the fibre is pulled from the outside end of a skein/ball, then it rolls around and creates further tangling and general sloppiness. If the fibre is pulled from the inside end of a skein/ball, then it would "hollow out" and lose its structure for the final 50%, e.g., the final 25% of the skein/ball.

Further, traditional multi-colour packages require the consumer to buy multiple single-colour skeins or to re-work a multi-colour skein before commencing the craft, which adds frustration and cost. And, these multi-colour packages are a random collection of coloured fibres, without any specific, discrete order, which prevents the consumer from viewing all of the colours or assessing the configuration of the colours (how much of each colour is present in the package). Thus, the colours cannot be separated from the traditional multi-colour packages without time consuming reworking by the consumer. Also in the traditional multi-colour packages the separation of the colours results in an associated lostof structural integrity. All of the colours of the package and the percentages of those colours in the package are not on display for the consumer's ease.

The inventors have now found that the buildup of a tubular windings having interlocking segments, each of which are built up from a fibre using three motions demonstrate significant structural integrity improvements. Adjacent segments at least partially overlap to create one or more interlocking connections. Each individual segment may be formed of a fibre having the same or different colours. The tubular winding may be formed from a continuous fibre or from several fibres that are built up in an interconnecting configuration. The improvements in structural integrity may provide for reductions in transit damage as well as the reduction or elimination of the need for wrappers, which add cost and complication to the manufacturing process. Importantly, the tubular windings are configured such that, when the fibre is pulled therefrom, the center section of the tubular winding does not "hollow out," and create structural and tangling problems in particular for the final half or quarter of the tubular winding. This provides an advantage of allowing segments to be separated, e.g. separated by colour, without losing structural integrity. This reduces the need to rework the tubular winding by the consumer.

In one embodiment, the segments are each made from a continuous fibre having one colour or continuous fibre having multiple colours, e.g., colours with different contrast or shading. The continuous fibre may comprise multiple strands that are connected. In some embodiments, multiple fibres may be used for each segment. Thus, the interlocking segments may each have a colour that contrasts with the adjacent segments. In some embodiments, the segments comprise a continuous fibre having colours that are arranged in a repeating pattern.

To achieve a buildup of the tubular winding, the method combines the shuffling (back and forth) motion of the fibre feed along with longitudinal motion in the axial direction of either the fibre feed or fibre buildup. These motions along with the spindle rotation motion provide for improved structurally integrity of the tubular windings. In some embodiments, the tubular windings comprise interlocking segments (optionally containing multiple aligned axial loops), which at least partially overlap with an adjacent segment to form the tubular windings. Additional details of the motions are provided below. Conventional skeins and balls are randomly wound, and result in mere layers of fibre, without any true interlocking structure/configuration and without axial loops. As a result, these lack integrity and consistency and are subject to the aforementioned transportation and tangling problems.

In addition to the structural benefits, the disclosed methods and tubular winding offer advantages in separating and distinguishing colour. Beneficially, the various coloured segments are essentially separable from one another without impacting the integrity of adjacent segments. For example, adjacent interconnected blue and red segments (of a multi-coloured tubular winding) may be pulled apart to yield a separate blue segment containing mostly blue fibre, and a separate red segment containing mostly red fibre. The ability to delineate and/or separate the colour segments is highly advantageous to the consumer because the consumer does not have work or unwind the multi-coloured tubular winding, separate and sever the colours, and manually rewind each separate colour into its own hank/skein in order to get separate, individually-coloured portions of fibre, as is the case with conventional multi-coloured packages. Still further, the coloured segments of fibre are fully on display for the consumer to see. As such, the consumer can beneficially see all of the colours of the tubular winding as well as the actual quantities of the respective colours.

Further, the inventors have found that the ends of the tubular windings can be effectively connected to one another (as discussed herein), which results in a continuous tubular winding (curved shaped tubular winding). In some embodiments, the curved shaped tubular winding may be in an open position when the ends do not touch or in a closed position when the ends touch. In one embodiment, the tubular winding may be curved in the shape of a ring, arc, spiral, or similar shape. Curved shaped tubular windings provide aesthetic and packaging benefits. For example, the curved shaped tubular windings can be hung or positioned without the need to use the packaging to maintain its structural integrity. This allows the tubular windings to be presented or displayed to the consumer in an aesthetically-pleasing manner. In some embodiments, the tubular windings may be packaged. Traditional skeins and balls are not able to be displayed in this manner without the addition of costly structural features in the packaging.

For the purpose of this disclosure the terms "yarn" and "fibre" refer to any fibre, natural (such as cotton, hemp, linen, silk, and/or wool), artificial (such as polyesters and/or acrylic), or blended, used in the fibre arts, including crochet, macrame, needlepoint, knitting, embroidery, tapestry, and/or another process of working fibre. The term conventional rolls includes skeins, pull skeins, hanks, balls and cakes. These conventional rolls typically required working by the consumer prior to use. As used herein unless noted otherwise the term skein will be used to refer to conventional rolls. A "tubular winding," as described herein, is different from conventional rolls and in particular skeins, for at least the structural and aesthetic reasons discussed herein.

Buildup of Tubular Winding

An example tubular winding system provides a method and apparatus for building a fibre packaging in the form a tubular winding from a continuous strand of fibre wound in a plurality of adjacent layers which consecutively extend along and surround itself (optionally over a core material). The ends of the core material may be fastened to each other. Once the ends of the core material are fastened, the tubular winding is held into the curved shape. The reduced bending range in compression or tension achieved may assist in keeping the segments interlocked.

In one embodiment, the disclosure relates to a method of building a tubular winding. The method comprises the steps of providing a fibre having a first fibre end, a fibre length, and a second fibre end and a rotatable spindle that extends along a spindle axis. The spindle has a first spindle end and an opposing second spindle end. The first spindle end is driven by a motor or other suitable means, while the opposing end allows for the tubular winding to be removed from spindle. The rotating speed of the spindle may be determined by the fibre material, thickness and/or weight of the fibre. In addition, the rotating speed may be determined by the number of segments. In one embodiment, a motor may operate a spindle rotating speed of up to 25,000 rpm, e.g., up to 20,000 rpm, up to 15,000 rpm, up to 10,000 rpm, up to 7,500 rpm, up to 5,000 rpm, or up to 1,500 rpm. In terms of ranges the rotating speed may be from 500 rpm to 25,000 rpm, e.g., from 500 rpm to 20,000 rpm, from 1000 rpm to 15,000 rpm, or from 1000 rpm to 10,000 rpm. The rotation of the spindle may be preferably in a fixed plane. In some embodiments, the motor may operate by rotating the spindle at a variable speed. For multiple spindle configurations, each spindle may be rotated independently.

In one embodiment, the process may include moving a tension guide to achieve the axial and/or back and forth motion (in relation to the spindle). In some embodiments, the motion may also include moving the spindle (in relation to the tension guide) to achieve the same goal. Both techniques, as well as other combinations, are contemplated.

In one embodiment, the method further comprises the step of attaching one end of the fibre, e.g., the first fibre end, to the spindle, e.g., the first spindle end. The first fibre end may be attached in a removable manner to the spindle. In general, the method further comprises the steps of rotating the spindle and winding the fibre length about the spindle axis to build the tubular winding, which has a first end and a second end and at least two segments that are interlocking. In one embodiment, the method comprises guiding the fibre in an overlapping back and forth motion in an axial direction along the spindle axis. The back and forth motion may have a throw, which is a measure of the distance traveled in the back and forth. The fibre may be guided through a tension guide, and the tension guide may be moved in an axial direction toward the opposing end while maintaining a substantially constant throw and cycle for the back and forth motion. In one embodiment, the method may adjust the throw between the back and forth cycles to bias the fibre along the spindle toward the opposing end to form each segment. In such embodiments, the throw may be adjusted by increasing the distance between the back and forth cycles while the tension guide is moved in an axial direction. In other embodiments, the axial motion may be substantially constant. In other embodiments, the axial motion may be controlled or paused to build up the tubular winding.

Figure 2A:
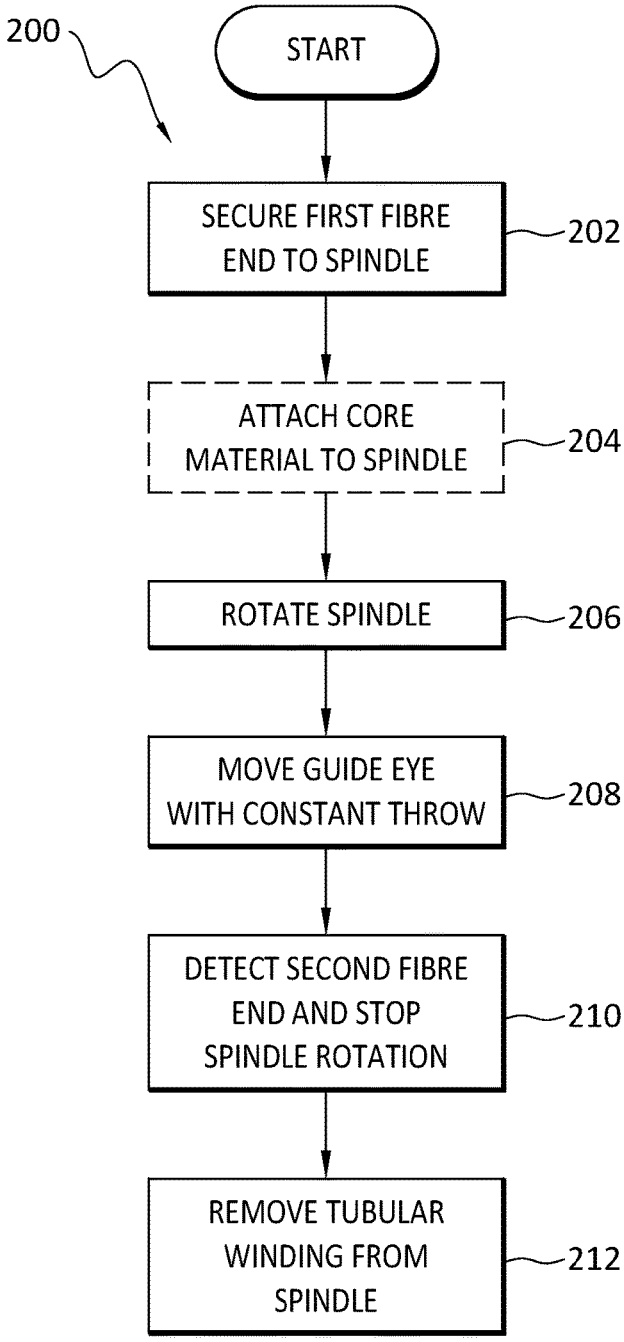
FIG. 2A is a flowchart of a winding method in accordance with one embodiment of the invention.
Figure 2B:
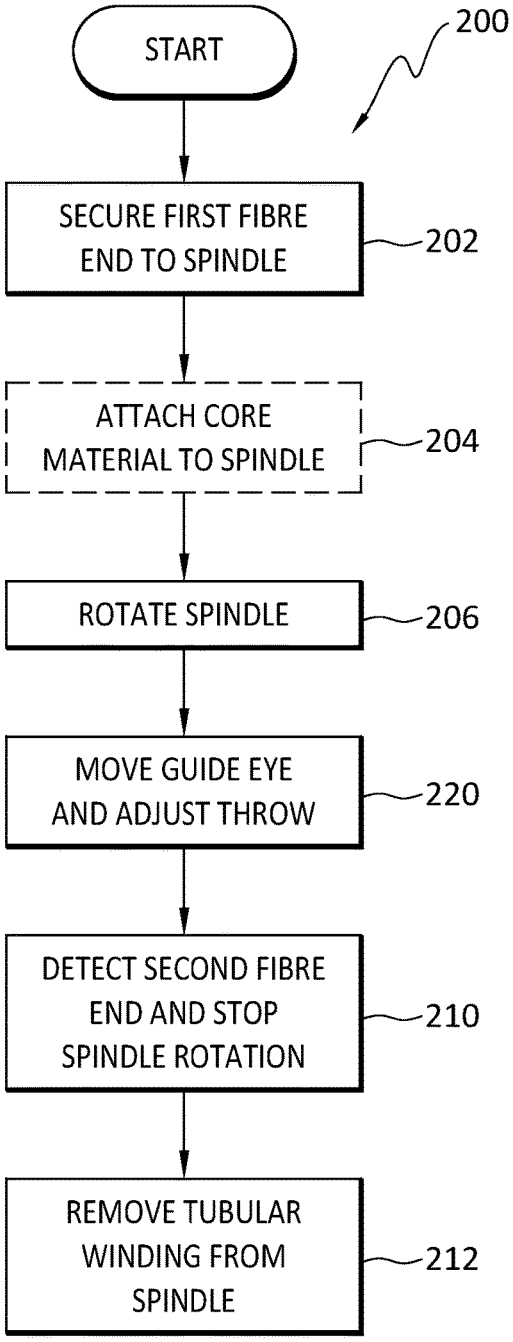
FIG. 2B is a flowchart of a winding method in accordance with one embodiment of the invention.

FIG. 1 is a purely schematic view of a winding machine 100 according to a preferred embodiment example, which is suitable for carrying out a method 200 according to one or more embodiments shown by the flowcharts schematically represented in FIGS. 2A and 2B. It is contemplated that industrial winding machines may have multiple spindles, but for the purposes of illustration one spindle is shown. Each spindle in a multiple spindle configuration may be driven by a common motor or may have dedicated motors. In addition, it is contemplated that one motor may drive multiple spindles.

Winding machine 100 comprises spindle 102, which rotates, for example in the direction indicated by arrow 104 on axis A. Spindle 102 may rotate in one direction to build up the tubular winding and may be clockwise or counter-clockwise direction. Spindle 102 has a first spindle end 106 that is mounted to a motor 108, preferably an electrical motor. Spindle 102 has an opposing end 112 that may be supported by a releasable arm 114. Releasable arm 114 allows the spindle 102 to rotate while providing support to maintain the spindle 102 in a fixed plane. In other embodiments, spindle 102 may be free and is not held by a support such as a releasable arm. In one embodiment, the first fibre end 132 may be secured to the first spindle end 106 using a knot, clip, holes, tie, clamp, brace, bracket, slit, and/or fastener. As indicated by in FIG. 1, near the first spindle end 106 is a slit 116 for securing a first fibre end 132 and/or optional core material (as discussed further herein). Likewise near the opposing end 112 there are one or more holes 118 for securing an opposing end of an optional core material. In some embodiments, at least some of the one or more holes 118 may be covered by releasable arm 114 when the spindle rotates. The one or more holes 118 allows for different lengths of core materials and/or tubular windings to be built on the spindle 102. It should be understood that other connectors may be used in place of the one or more holes 118, such as slits or clips.

In some cases, the spindle 102 may be oriented in a horizontal plane. In other cases, the spindle 102 may be oriented in a vertical and/or angular presentation. Regardless of the orientation, the spindle 102 preferably rotates in a fixed plane about axis A. Furthermore, the spindle 102 may have a fixed length and diameter or, alternatively, a variable diameter. Spindle 102 may have a length that is from 0.1 to 3 m, e.g., from 0.1 to 1.5 m, from 0.1 to 1 m, or from 0.1 to 0.5 m. Spindle 102 may have an outer diameter that is from 0.1 cm to 10 cm, e.g., from 0.1 cm to 5 cm, from 0.1 to 4 cm or from 0.1 to 3 cm. Aside from the securing devices, e.g., slits and/or holes near the ends, spindle 102 may have an even surface that reduces snagging of the fibre. Spindle 102 may be constructed of a suitable metal or plastic material. In some embodiments, the spindle 102 may comprise a shaft mounted on a rotating mandrel. In yet other embodiments, the spindle has a conical region in first spindle end 106.

Winding machine 100 comprises a tension guide 120 having a post 122 that travels along support beam 124. The opening of the tension guide 120 is sufficient to allow the fibre to pass through, and in some embodiments may be a loop, hook, eye, or similar type of guide. Tension guide 120 maintains tension on the fibre 120 as the fibre is wound into the tubular winding. Tension guide 120 may be moved in a back and forth direction by an arm 126 that is connected to a secondary motor 129, preferable a back and forth like movement shown by arrow 121 in FIG. 4. The arm 126 may be connected to the tension guide 120 or may be connected to the post 122. The arm 126 is flexible to absorb the back and forward movement without breaking. In addition, the arm 126 may be biased to hold post 122 against support beam 124. Support beam 124 may be preferably constructed of a solid material to provide a movement path for the post 122. In one embodiment post 122 is moved in the axial direction as shown by arrow 123 along a track or chain (not shown) connected to the support beam 124 and driven by a motor 129. The movement shown by arrow 123 is preferably in one direction towards the opposing end 112 of spindle 102. The movement speed in the axial direction may be constant or may be adjusted depending on the fibre parameters. In one embodiment, the movement speed along arrow 123 is greater than 1 m/min, e.g., greater than 1.1 m/min, greater than 1.2 m/min, greater than 1.5 m/min or greater than 2 m/min. Support beam 124 may be mounted in a longitudinal plane, i.e. one being substantially parallel, to the axial direction as indicated by axis A. In some embodiments, the support beam 124 has a length that is equal to or longer than the spindle 102.

Figure 4:
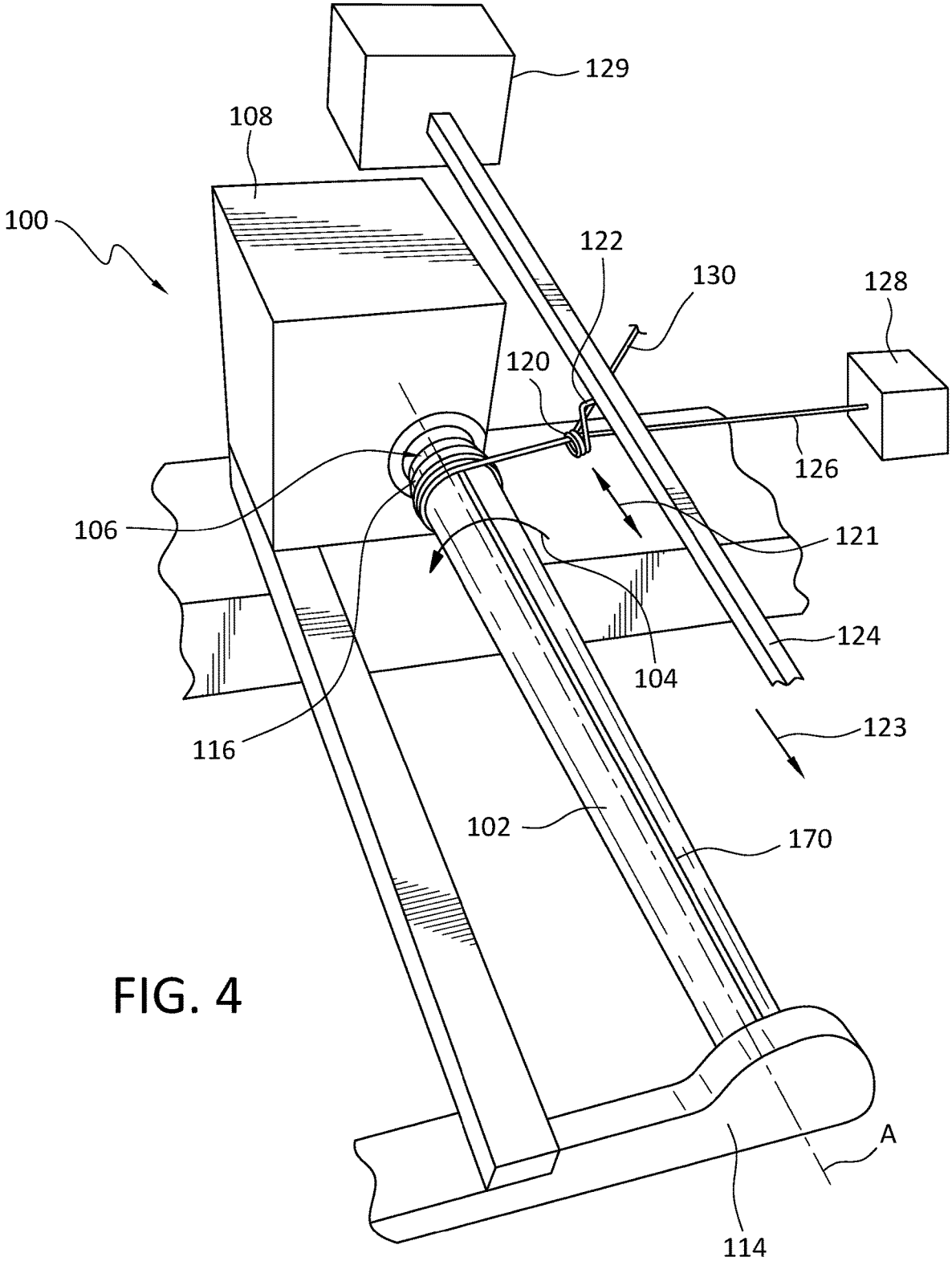
FIG. 4 is a schematic illustration of winding motion at the initial stage for buildup the tubular winding in accordance with one embodiment of the invention.

It should be understood that for each movement used to form the tubular winding, spindle rotation shown by arrow 104, back and forth shown by arrow 121, and axial direction shown by arrow 123 in FIG. 4, may be driven by one motor or dedicated motors.

In some embodiments, a winding drum may be used in place of a tension guide and the back and forth movement is provided by the winding drum. The winding drum may be moved in an axial direction, and in some embodiments the winding drum may be moved along the support beam 124.

The uptake portion of the winding machine may vary widely. In one embodiment, the uptake portion of the winding machine 100 loads the fibre 130 having a first fibre end 132 onto the spindle 102. Without limitation the fibre 130 is loaded into the winding machine 100 from a spinning can 140. In one embodiment, fibre may be aligned a length of the spindle in an axial direction. In one embodiment, fibre 130 is a continuous fibre that preferably has one or more sections dyed a different colour. In other embodiments, fibre 130 may comprise multiple fibres that are adjoined or separately wound in the manner described herein. Fibre 130 is taken up through a fibre guide 142 and may pass over one or more tension rods 144 and one or more guide rollers 146. Tension rods may also be placed downstream of the guide rollers. Tension rods 144 provide sufficient tension on the fibre to ensure the winding occurs without relaxing or snagging. In the example embodiments, a strain gauge/tension adjuster can be employed to adjust the tension on the fibre to be wound to increase or decrease the density of the winding. The winding tension serves to establish a desired density or diameter of the winding for packaging purposes. For example, different tensions may be needed to achieve the desired package presentations, as described herein. In addition, the tension may reduce slippage and fluctuations in the buildup of the fibre. In some embodiments the winding machine 100 may also comprise a stop motion feeler 148, a tension sensor 150, and fibre clearer 152. The tension sensor may comprise a sensor and/or camera to detecting the tension of the fibre 130 and outputs a control signal to adjust the tension rods 144. In some embodiments, there may be provided a detector 154 that measures one parameter of the fibre and/or tubular winding. The detector 154 provides a control signal to the control unit 160. In one embodiment, detector measures is a fibre length counter and outputs a signal based on a total fibre length for the tubular winding. In other embodiments, detector 154 may measure a change in colour and/or thickness of the fibre. When detector 154 is used for the tubular winding, the detector may measure the thickness of the buildup fibre 130 on the spindle 102. In some embodiments, a cutting station 156 may be used to create a second fibre end 134 when the fibres are formed into a tubular winding having one or more segments.

In addition, the winding process may be a purely mechanical process controlled by the length and/or weight of the fibre material being wound or it can be a computerized/automated process controlled by a programmable logic controller (PLC) that automates control based on the length, weight, density, colour and/or thickness of the fibre. These are referred to the fibre parameters and one or more of these parameters may be measured during the winding process and adjusted. Winding machine 100 may also comprise a control unit 160 that operates the control mechanisms of the winding machine, such as the motors, tension rods, and/or stop motion feeler. Control unit 160 may receive the inputs from the various sensors and detectors. In one embodiment, control unit 160 may be a computer with a memory and an operating unit. The control unit 160 may comprise a display for indicating the parameters of the winding machine 100 as well as receiving inputs to configure the operating of the winding machine 100.

Figure 3:
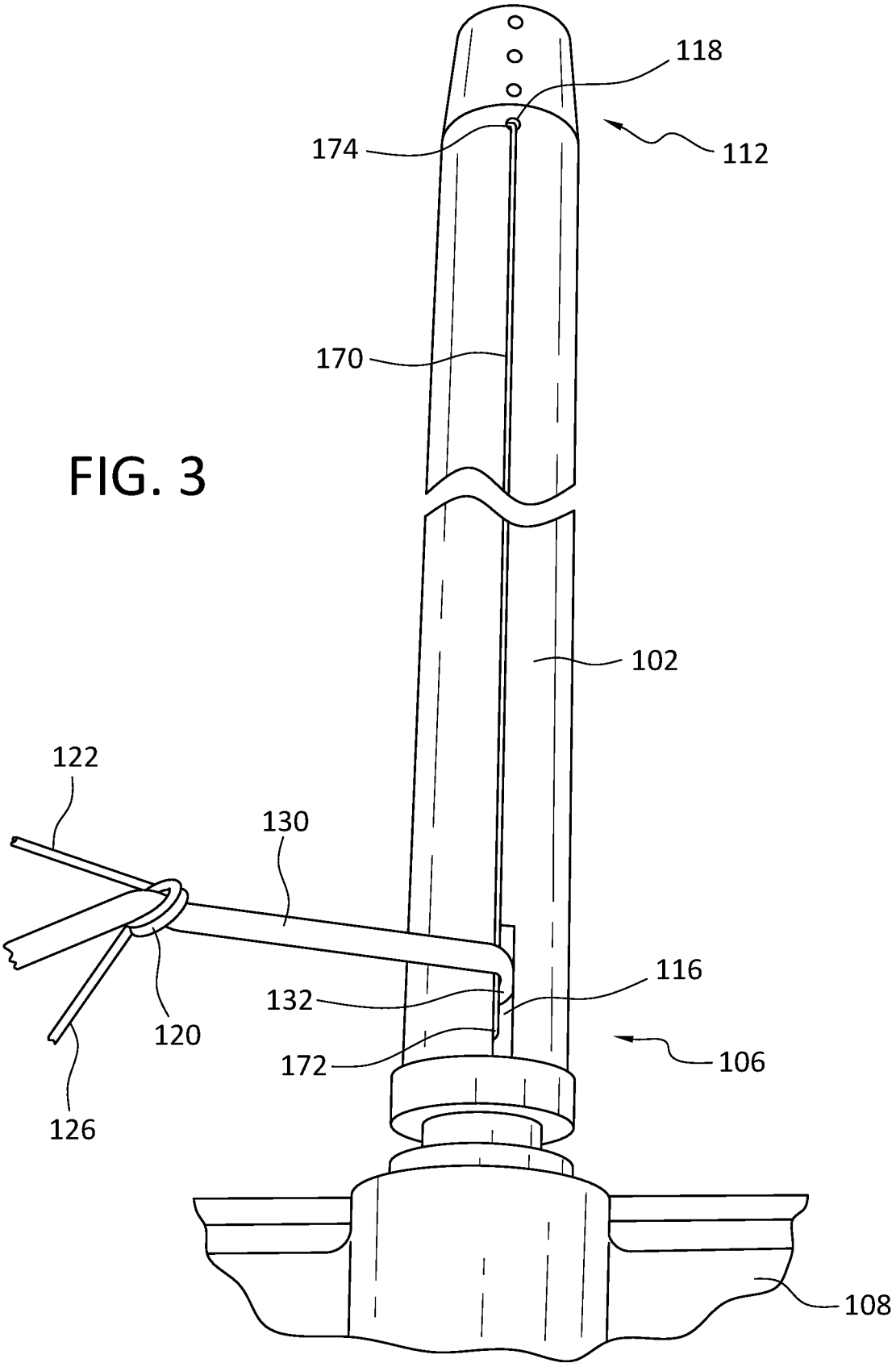
FIG. 3 is a schematic illustration of spindle having the fibre secured to a slit in accordance with one embodiment of the invention.

FIG. 2A and FIG. 2B are simplified flowcharts of the method 200 for building up a tubular winding according to embodiments using a continuous fibre 130 having differently dyed portions. In step 202 the continuous fibre 130 is passed from a spinning can 140 along a tension rod 144 and guide rollers 146 and through a tension guide 120 and the first fibre end 132 is secured to a spindle 102. It should be understood that a portion comprising the first fibre end 132 may be secured to the spindle 102 near the first spindle end 106 in a removable fashion. In one embodiment, the first fibre end 132 may be secured using a knot, clip, tie, clamp, brace, bracket, and/or fastener or may be secured by being positioned in a slit 116 on the spindle 102 as illustrated in FIG. 3. Combinations devices for securing the first fibre end 132 may be employed in some embodiments and in addition, the first fibre end 132 may be tied or looped in an overlapping manner on the spindle 102.

Step 204 is optional when a core material 170 is employed and may be used to form a curved shaped tubular winding. In some embodiments, securing the optional core material 170 in step 204 may occur before securing the fibre in step 202. When a more linear shape is desired a core material 170 may not be employed. In optional step 204, the one end 172 of the core material 170 is secured to the spindle 102 in a removable fashion using a clamp, brace, bracket, and/or fastener or may be secured by being positioned in a slit 116 on the spindle 102 near the first spindle end 106 as shown in FIG. 3. In one embodiment the core material 170 is secured in the same manner as the first fibre end 132 so that the first fibre end 132 and core material 170 may be removed together after the tubular winding is built up. In other embodiments, the core material 170 may be secured in a different manner as the first fibre end 132. For example, the core material 170 may be secured inside a hollow portion of the spindle 102. Returning to FIG. 3, the opposing end 174 of the core material 170 is secured on the opposing end 112 of the spindle 102 to position the core material 170 alongside the outer surface of the spindle 102 to avoid the core material 170 from being tangled with the fibre 130. In one embodiment, the core material 170 may be secured in a hole 118 provided on the spindle 102. In one embodiment, the core material 170 may be a plastic wire and more preferably a semitranslucent, translucent, semitransparent or transparent plastic wire. Although the core material 170 is preferably a plastic core material, the core material can be made of a different material and/or have a different shape or there may be no core material and the fibre 130 may be wound around itself.

In an alternative process, the fibre can be wound around the spindle without attaching the core material to the spindle. Upon completion of the winding, one end of the core material may be attached to the end of the spindle and the tubular winding is slid off the spindle and onto the core material.

In step 206, the control system 160 starts the motor 108 to rotate the spindle 102 in a fixed plane along axis A as shown by arrow 104 and starts the motion of the tension guide, preferably a back and forth motion shown by arrow 121. In one embodiment, spindle rotation speed and/or the cycle time of the back and forth motion corresponds at least one fibre parameter. FIG. 4 is an illustration of a winding machine 100 when the control system 160 activates the mechanisms. As spindle 102 rotates, fibre 130 is wound about the axis A of spindle 102 to buildup fibres into a tubular winding. In one embodiment, the fibre 130 are wound in a partially overlapping configuration due to the back and forth motion which reduces tangling. The throw of the back and forth motion is less than the length of spindle and more preferably less than the length of the segment. The cycle time of the back and forth motion may be substantially constant or may be adjusted.

In general the fibre 130 may be wound with a side-by-side winding, such as a hoop winding, or an overlapping winding, such as a honeycomb winding, spiral winding, and/or helical winding. In some embodiments, polar winding is not employed for building up the segments of the tubular winding (but it is not excluded for other embodiments). The fibre 130 may be wound with a winding pitch that is preferably less than the length of the segment. In one embodiment, the winding pitch is less than 30% the length of the segment, e.g., less than 25% the length of the segment or less than 20% the length of the segment.

In FIG. 2A in step 208, the control system 160 operates the tension guide 120 in an axial direction shown by arrow 123 toward the opposing end 112 of the spindle 102. As the tension guide 120 moves, a substantially constant throw and cycle of the back and forth motion is provided to achieve a back and forth like motion as indicated by arrow 121. In some cases, a substantially constant throw may include a small change between successive throws that is less than 1% of the throw distance, e.g., less than 0.5% or less than 0.1%. Substantially constant cycle may include variations in the cycle that are within 5% of the average cycle. Larger changes in the cycle may, in some cases, lead to the fibre being wound too tight leading to breakage or being wound too loose causing the tubular winding to lose its shape on the spindle. Such problems may also lead to jamming of the spinning equipment. Other problems may include difficulty in removing the tubular winding from the spindle. The movement of the tension guide 120 may be a near constant movement in the axial direction so that the fibre is wound in an overlapping configuration on the spindle. Post 122 maintains tension guide 120 in a spaced apart relationship with spindle 102. Due to the differently dyed continuous fibre, segments based on colour are formed as interlocking segments as the fibre is wound.

In FIG. 2B in step 220, the control system 160 may increase the throw of the back and forth motion as the tension guide 120 moves in an axial direction shown by arrow 123. In one embodiment, the throw in the forward direction may be increased, while the throw in the back direction remains substantially constant. As used herein the forward direction is from the first spindle end to the opposing end of the spindle, while the back direction is the opposing movement. Increases in the throw may occur based on the fibre parameters and/or spindle speed. In addition, the movement in axial direction may be constant or may be adjusted. In other embodiments, a detector 154 may be used to signal when the buildup of fibre on the spindle reaches the desired thickness. Once the desired thickness is obtained, the throw is increased in the forward direction. Due to the differently dyed continuous fibre, segments based on colour are formed as interlocking segments as the fibre is wound.

Figure 5A:
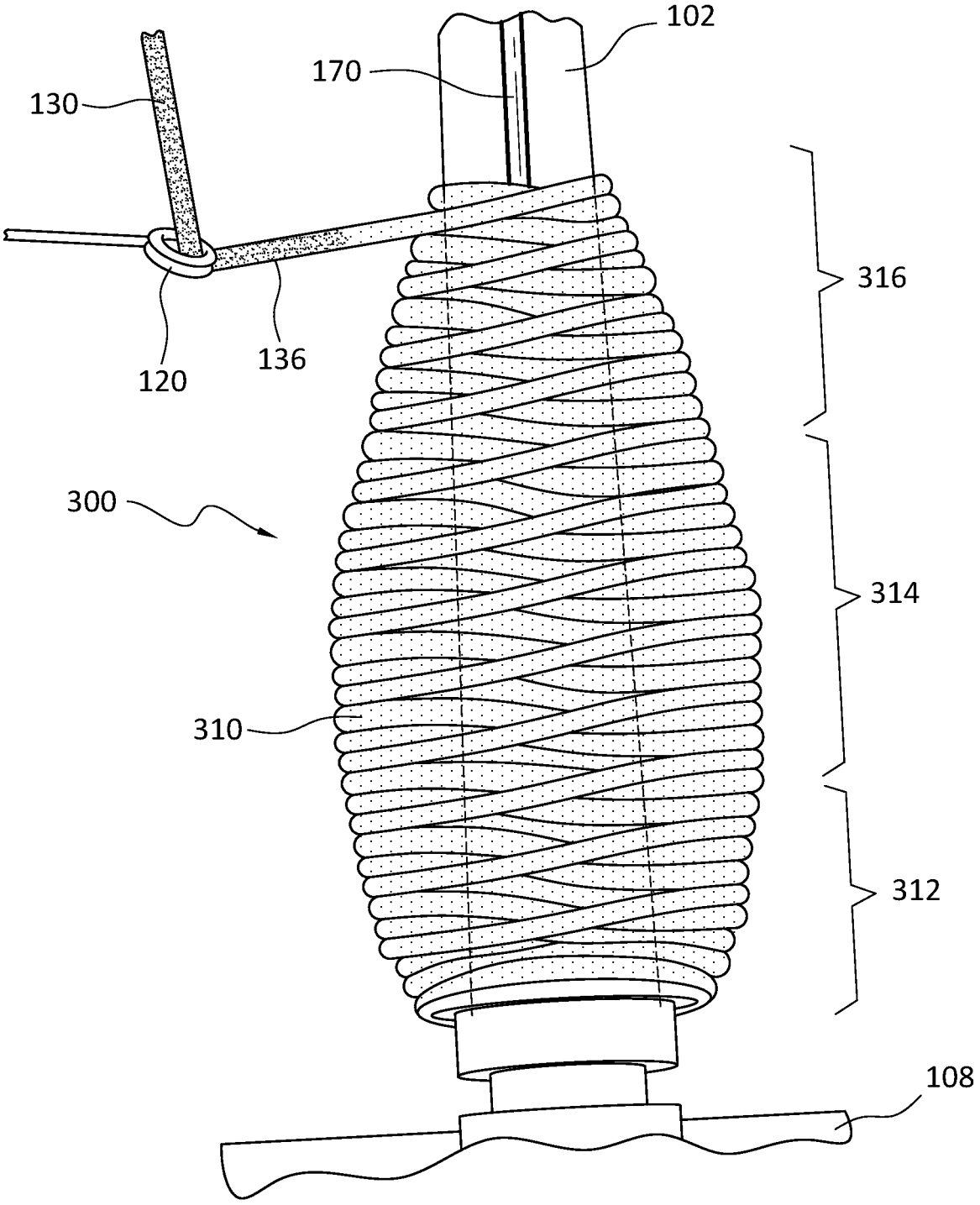
FIG. 5A is a schematic illustration of spindle showing the buildup of one segment in accordance with one embodiment of the invention.
Figure 5B:
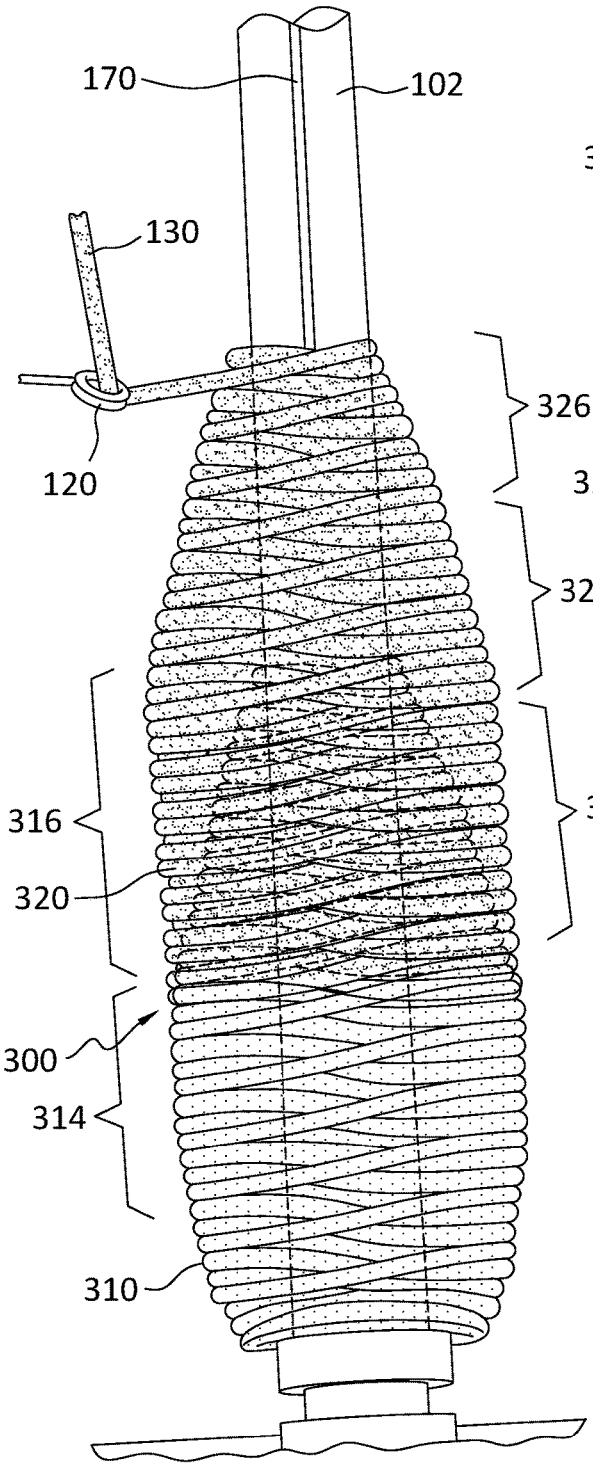
FIG. 5B is a schematic illustration of spindle showing the buildup of two segments in accordance with one embodiment of the invention.
Figure 5C:
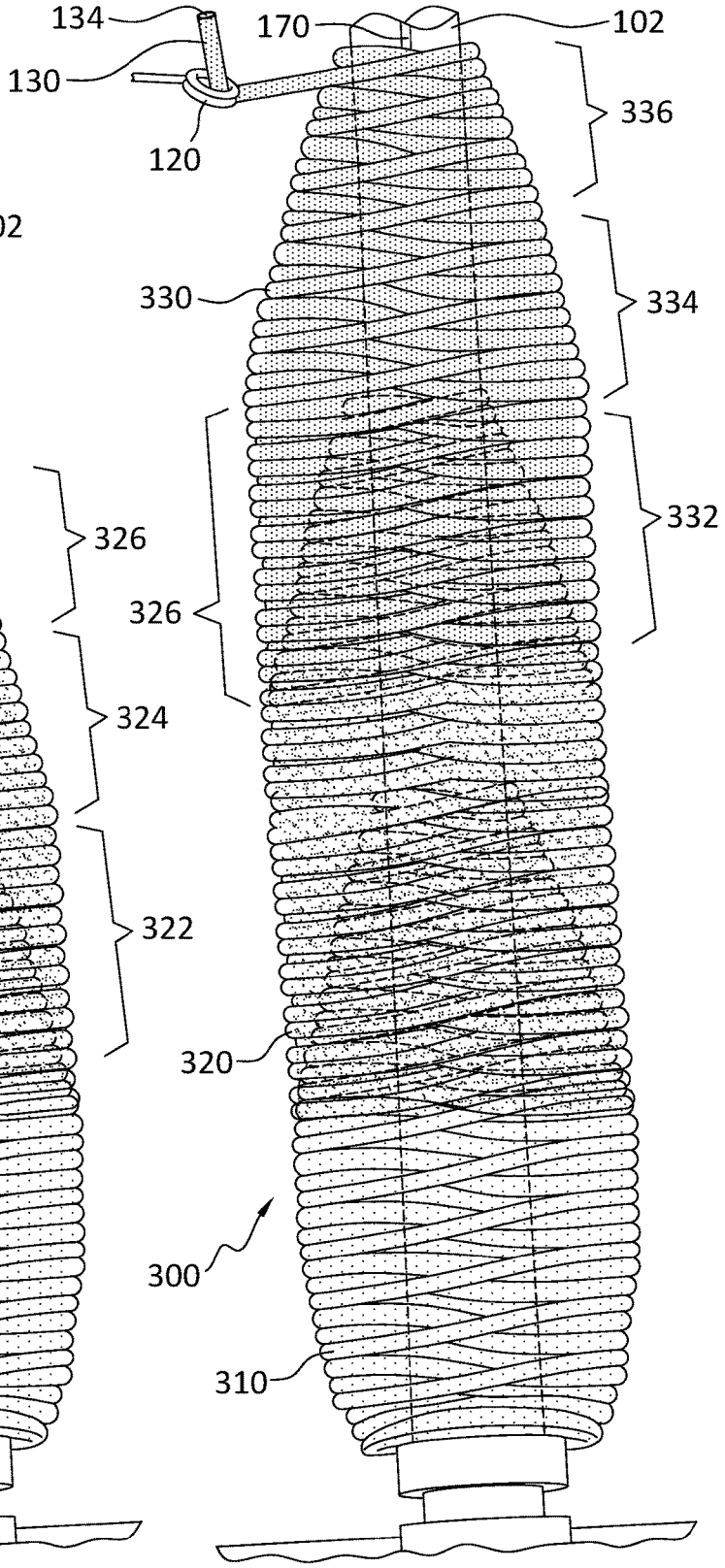
FIG. 5C is a schematic illustration of spindle showing the buildup of three segments in accordance with one embodiment of the invention.

FIGS. 5A-5C illustrate the buildup of the tubular winding 300 according to the methods described herein. In FIG. 5A shows fibres 130 being built into a first segment 310 having one colour shade on the spindle 102. The build time for each segment is economic and/or efficient to allow increased production. The production may have fibre buildup times that are between 1 and 30 seconds, e.g., between 1 and 15 seconds, between 1 and 10 seconds, or between 1 and 5 seconds. First segment 310 has an end region 312, base region 314, and tip region 316. As shown in FIG. 5A each region comprises multiple partially overlapping loops of fibre 130 around core material 170. The regions lack defining boundaries and generally have the following features. The end region 312 comprises the first fibre end (not visible in FIG. 5A) and when assembled into the tubular winding 300 may abut an opposing end region. Base region 314 represents the portion of the segment that will be primarily viewable by a user when in a curved shape. In one embodiment, the base region 314 encompasses the maximum diameter for the first segment 310. Thus, the base region 314 has a diameter that is larger than the end region 312 or the tip region 316. Tip region 316 may be tapered having a diameter that is smaller than the base region 314 to provide for interconnection with an adjacent segment. As shown in FIG. 5A the fibre 130 has a second region 136 that passes through the tension guide 120 to build up the second segment starting in the tip region 316 of the first segment.

FIG. 5B shows the continuing building of the tubular winding 300 by having a second segment 320 wound onto the tip region 316 of the first segment. In this embodiment, the segments are defined by a contrasting colour shades. The fibre 130 is a continuous fibre between the first 310 and second segments 320. Second segment 320 comprises an overlapping region 322, base region 324 and tip region 326. Each region comprises multiple partially overlapping loops of fibre 130 around core material 170. Thus, each segment may be wound around the core material. Similar to the first segment, the regions of the second and subsequent segments lack defining boundaries and generally have the following features. Base region 324 and tip region 326 of the second segment 320 are similar in nature to the corresponding regions in the first segment 310. Overlapping region 322 is wound onto the tip region 316 of the first segment 310. In one embodiment, at least 75% of the tip region 316 is overlapped by overlapping region 322, e.g., at least 80%, at least 85%, at least 90% or at least 95%. In one embodiment the combination of the overlapping region 322 and tip region 316 has a diameter that approximates the base region of either segment. This overlapping creates an interlocking configuration between the first segment 310 and second segment 320. In one embodiment, this positions the base regions of the first segment 310 and second segment 320 to be near to each other and both are visible. As shown in FIG. 5B, the overlapping region 322 is adjacent to the base region 314 of the first segment 310. When the segments are pulled apart the overlapping region 322 may have a carved out interior having the opposing taper of the tip region 316. As noted, in some cases, the tubular winding 300 comprises more than two segments, e.g., more than three segments, more than four segments, more than five segments, more than six segments, more than ten segments, more than twelve segments, or more than fifteen segments. In terms of ranges the number of segments may vary from 2 to 20, e.g., from 3 to 20, from 4 to 20, from 5 to 20 or from 6 to 20. Thus, the process may repeat to build up several interlocking second segments, where the overlapping regions are built on the tip regions of the adjacent segment.

For purposes of illustration FIG. 5C is a tubular winding 300 having a first segment 310, second segment 320 and third segment 330. The third segment 330 comprises the second fibre end 134 which may hang loosely. In some embodiments the second fibre end 134 may be cut. The second fibre end 134 may be tucked into the loops or may be freely hanging. Similar to the other segments third segment 330 comprises an overlapping region 332 built on the tip region of the segment, base region 334 and end region 336. Base region 324 and overlapping region 332 of the third segment 330 are similar in nature to the corresponding regions in the other segments. In one embodiment, at least 75% of the tip region 326 is overlapped by overlapping region 332, e.g., at least 80%, at least 85%, at least 90% or at least 95%. Once the tubular winding 300 is withdrawn from the spindle, the end region 336 will abut the end region 312 of the first segment in a curved shaped. The core material 170 may be connected to maintain its shape. In the third segment 330, the end region 336 may be less tapered than a tip region, but may have slight tapering or rounded shape. This interlocking configuration provides for some of the structural benefits described herein. Advantageously each adjacent segment may be separable.

In one embodiment, in step 210, the detector 154 detects at least one parameter of the fibre 130. The parameter may be a fibre length and the detector 154 is a length counter and once the fibre length is achieved the cutting station 156 forms the second fibre end 134 and signals to the controller 160 to stop the motors, such as the motor 108 for the spindle 102. Likewise the secondary motors 128 and 129 may also be stopped simultaneously or successively. The second end 134 of the fibre 160 may hang in a loose manner so that the consumer can withdraw the fibre without having to rework the tubular winding or tangling the fibres. In other embodiments, the motors 108, 128 and 129 are stopped and the fibre 130 is cut to form the second fibre end 134.

Next in step 212, the first fibre end 132 and both ends of the core material 170, if used, are removed from the spindle 102. In some embodiments, the core material ends 172, 174 may be fastened together to form a curved shape tubular winding and packaged for delivery to the consumer. The core material may include a connector for securing the ends 172, 174 to each other. For example, the connector may be a knot, clip, or tie or combination thereof. This list is exemplary and is not intended to be limiting. Alternatively, the core may have a tubular/cylindrical shape, the inner diameter of which may define the inner diameter of the tubular winding. In such a case, the winding can be removed from the spindle by releasing/sliding the winding off the spindle without fixing the ends of the core to each other. In one embodiment, the first fibre end 132 and the second fibre end 134 may be conjoined. In other embodiments, the tubular winding may be packaged in any suitable shape and delivered to the consumer.

In one embodiment, the spindle may have a support disc. The support disc may preferably be movable on the spindle. In one embodiment, the method further comprises the step of attaching one end of the fibre, e.g., the first fibre end, to the support disc. The first fibre end may be attached in a removable fashion to the support disc. In one embodiment, the method further comprises the steps of rotating the spindle and winding the fibre length about the spindle axis to build up the tubular winding, which has a first end and a second end and at least two segments that are interlocking. In one embodiment, the method comprises guiding the fibre in an overlapping back and forth motion having a substantially constant throw as the support disc is moved toward the opposing end of the spindle. The support disc may be pushed by the pressure from the winding fibre or may be mechanically driven toward the opposing end of the spindle. The movement may be controlled to form each segment of the tubular winding.

Figure 6:
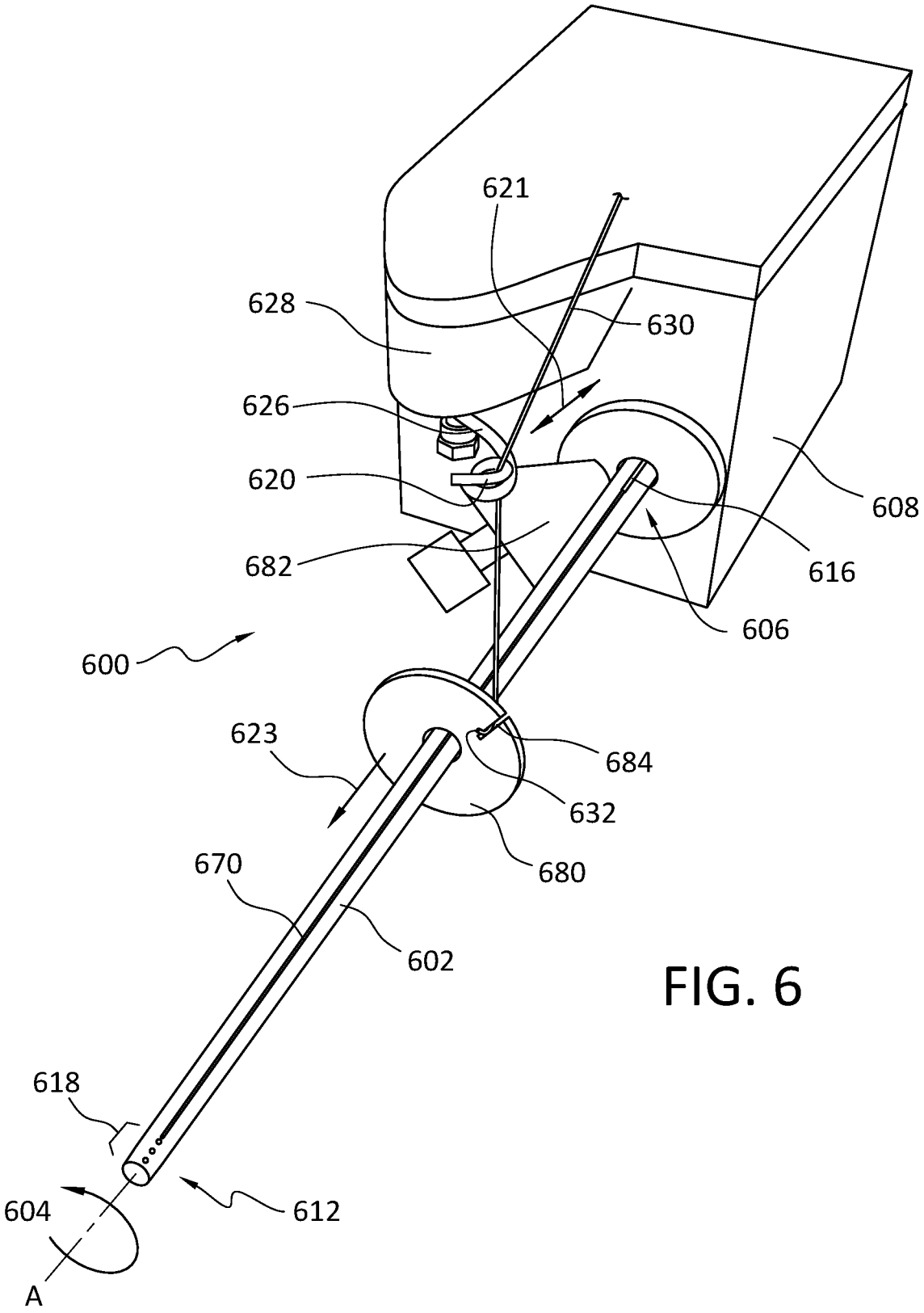
FIG. 6 is a schematic illustration of spindle having the support guide in accordance with one embodiment of the invention.
Figure 7:
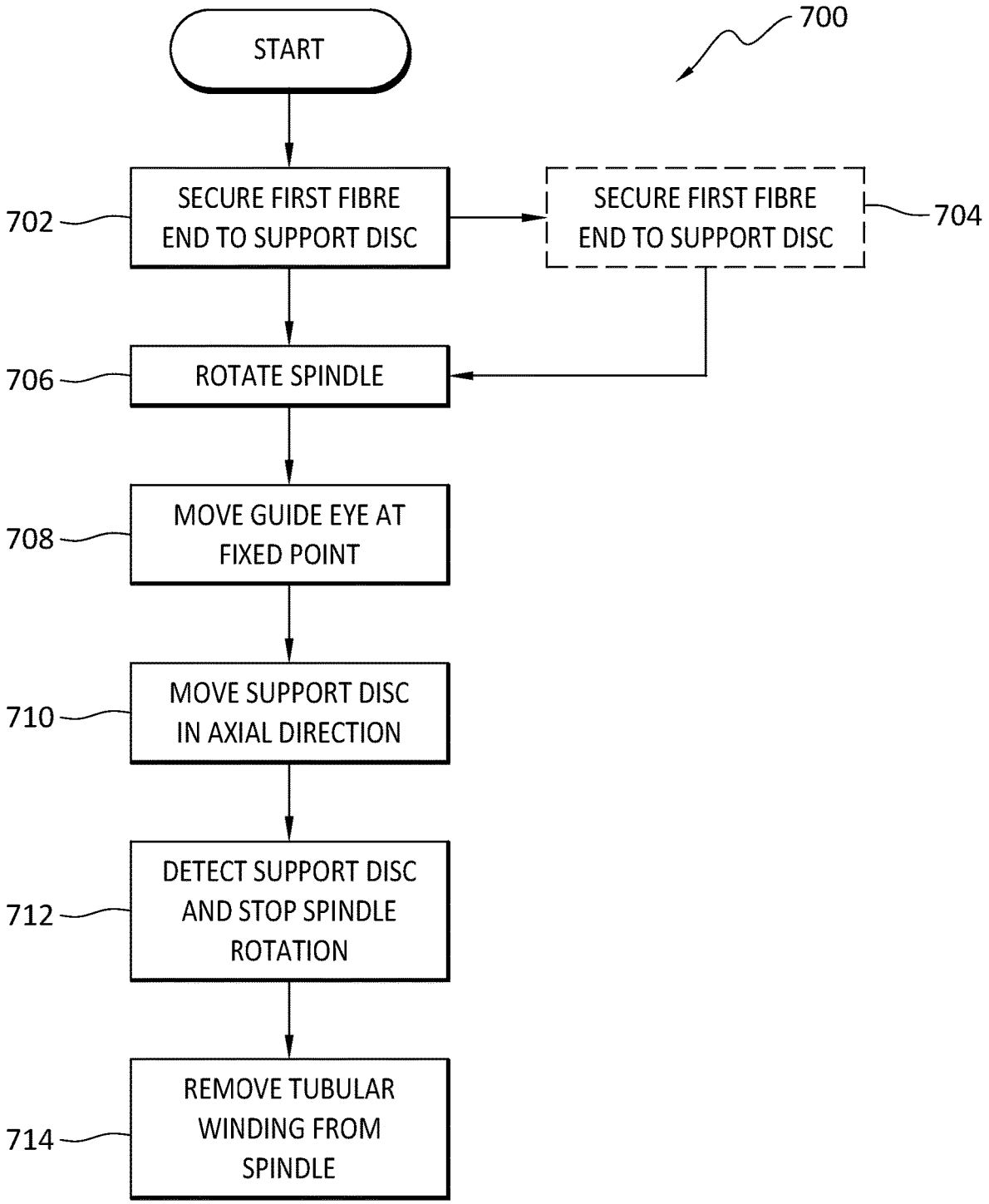
FIG. 7 is a flowchart of a winding method in accordance with one embodiment of the invention.

FIG. 6 is a purely schematic view of a winding machine 600 according to a preferred embodiment example, which is suitable for carrying out a method 700 according to one or more embodiments shown by the flowcharts schematically represented in FIG. 7. Winding machine 600 incorporates several features as the winding machine described in FIG. 1, and those similar features are not further repeated.

In one embodiment, winding machine 600 comprises a spindle 602 that rotates and has a first spindle end 606 with a slit 616 and an opposing spindle end 612 with one or more holes 618. As shown in FIG. 6 spindle 602 may be open at the opposing spindle end 612 without a support arm. In other embodiments a releasable arm similar to FIG. 1 may be used. The uptake portion for winding machine may be similar to FIG. 1 and for purposes of illustration is not shown in detail in FIG. 6. In this embodiment, winding machine 600 operates using a support disc 680 and pusher 682. Support disc 680 may be slidable and may be removed from the spindle 602 and may have one or more slits 684 for securing the first fibre end 632. In one embodiment, the first fibre end 634 may be secured using a knot, clip, tie, clamp, brace, bracket, and/or fastener or may be secured by being positioned in a slit 684 on the support disc 680 as illustrated in FIG. 6. Pusher 682 functions to shape the segments of the tubular winding. In one embodiment, pusher 682 may be adjustable in terms of distance from the spindle and/or rolling speed. Pusher 682 may press on the fibre being wound on the spindle 102. In one embodiment, pusher 682 has a conical shape or similar angular shape. In addition, the tension guide 620 is connected to a bracket 626 that is connected to a fix point to move back and forth in a defined area. The secondary motor 628 moves the tension guide 620 in a back and forth motion. In one embodiment, the throw may be substantially constant.

Alternatively, the winding may be created by the fluctuating fibre guide (for the back and forth motion) moving horizontally to the rotating spindle without a pusher. In other alternatives, the winding can be created by a fibre guide that fluctuates in a fixed or moving position, and the bed of the winding machinery being moved in response to automated mechanical or computer directed instructions to create the material winding.

The latter alternative, e.g., the one in which the machinery frame moves, can be subdivided into two further versions. One in which the frame moves and the guide shuffles back and forth in a short range to form the winding but is otherwise in a fixed position on or adjacent to the frame, and another where the machinery frame moves and the guide not only shuffles back and forth in a short range but also moves the length of the desired winding. In one embodiment, one or more spindles with the moving platform for winding the fibres. In a further still alternative method the spindle is in a fixed position and the guide rotates around the spindle winding the fibre about the fixed spindle. The guide may itself be configured to rotate or a frame to which the guide is attached or adjacent may move to rotate the guide about the fixed spindle.

FIG. 7 is a simplified flowchart of the method 700 for building a tubular winding according to embodiments using a continuous fibre 630 having differently dyed portions. In step 702 the continuous fibre 630 is loaded from the uptake portion and fed through the tension guide 620 and secured to at least one of the one or more slits 684 on the support disc 682. Step 704 is optional when a core material 670 is employed as described herein. In some embodiments, securing the optional core material 670 in step 704 may occur before securing the fibre 630 in step 702. In other embodiments, the core material 670 is not used and the fibre 630 is wound on the spindle 602.

In step 706, a control system (not shown) starts the motor 608 to rotate the spindle 602 in a fixed plane along axis A as shown by arrow 604 and in step 708 starts the motion of the tension guide, preferably a back and forth motion shown by arrow 621. Steps 706 and 708 may operate in successive order or tandem. As the thickness of the tubular winding increases it abuts pusher 682 which thereby induces support disc 680 to move in an axial direction in step 710. As more fibre is wound the support disc 680 is further moved as shown by arrow 623. In one embodiment, once support disc 680 reaches a detection location on spindle 602, one or more motions (spindle rotation and/or back and forth motion) may be stopped in step 712. In another embodiment, a fibre length detector may be used to determine a desire build up and one or more motions may be stopped in step 712. The second fibre end 634 may be cut and the tubular winding is removed in step 714.

Figure 8A:
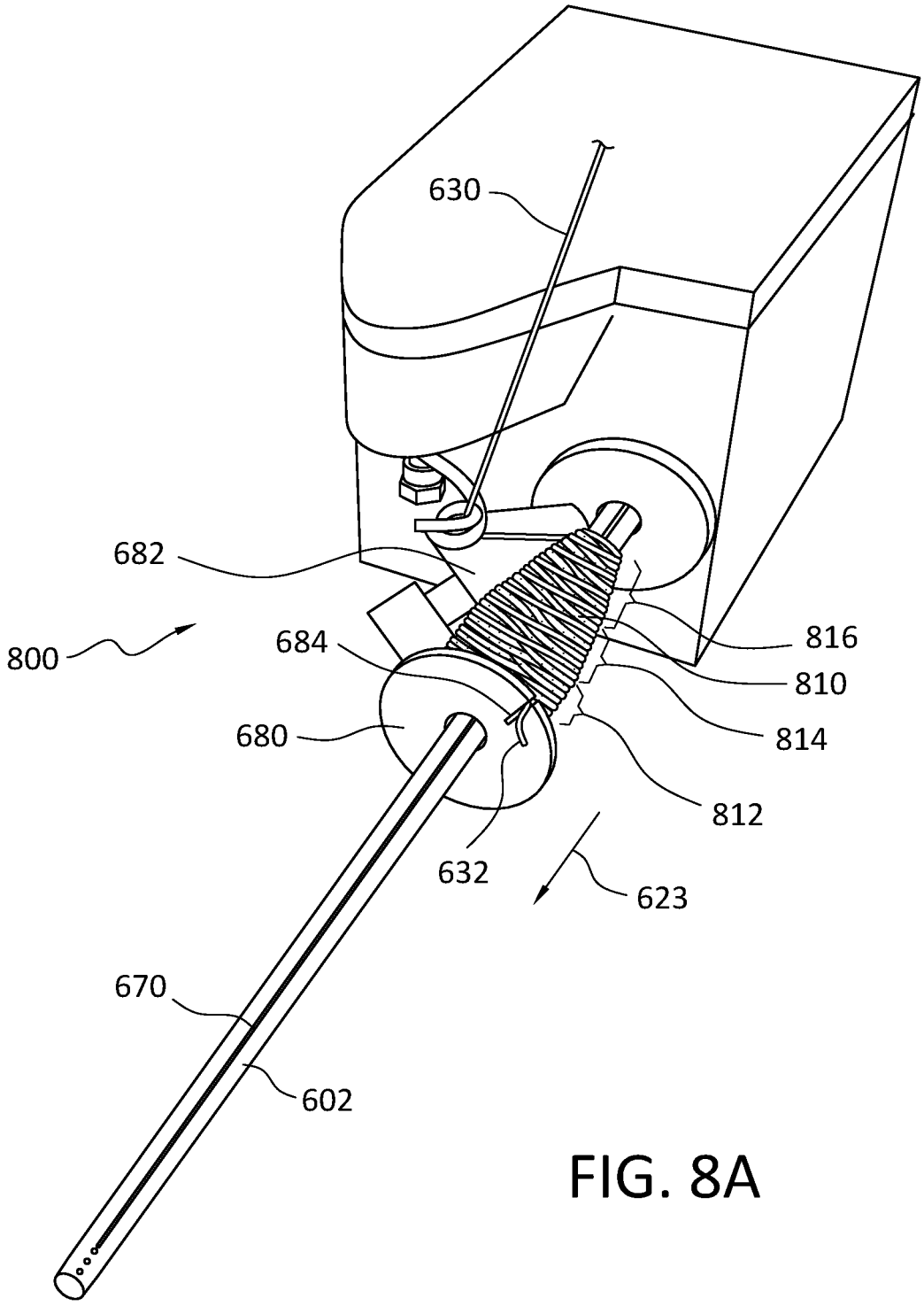
FIG. 8A is a schematic illustration of spindle showing the buildup of one segment in accordance with one embodiment of the invention.
Figure 8B:
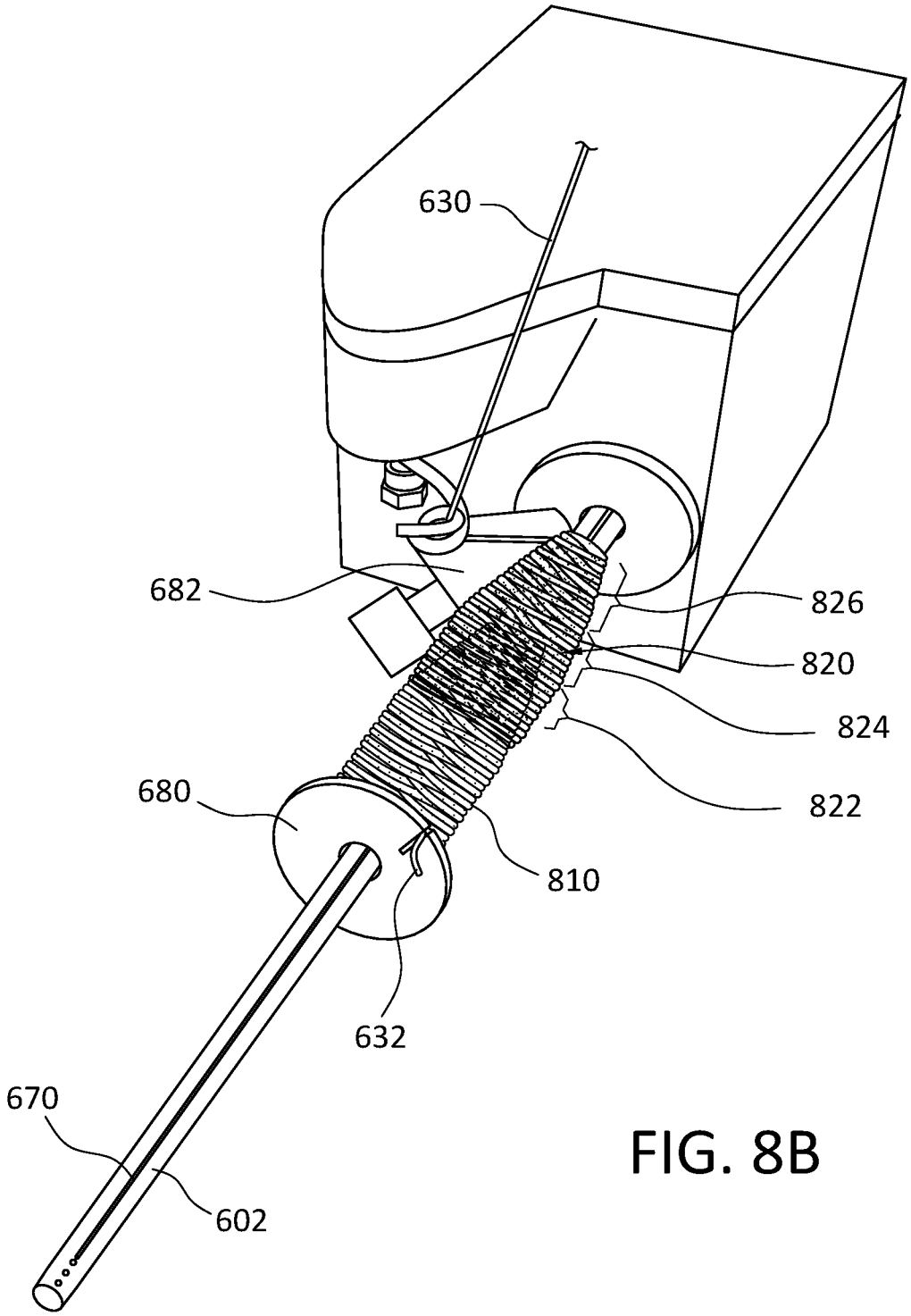
FIG. 8B is a schematic illustration of spindle showing the buildup of two segments in accordance with one embodiment of the invention.
Figure 8C:
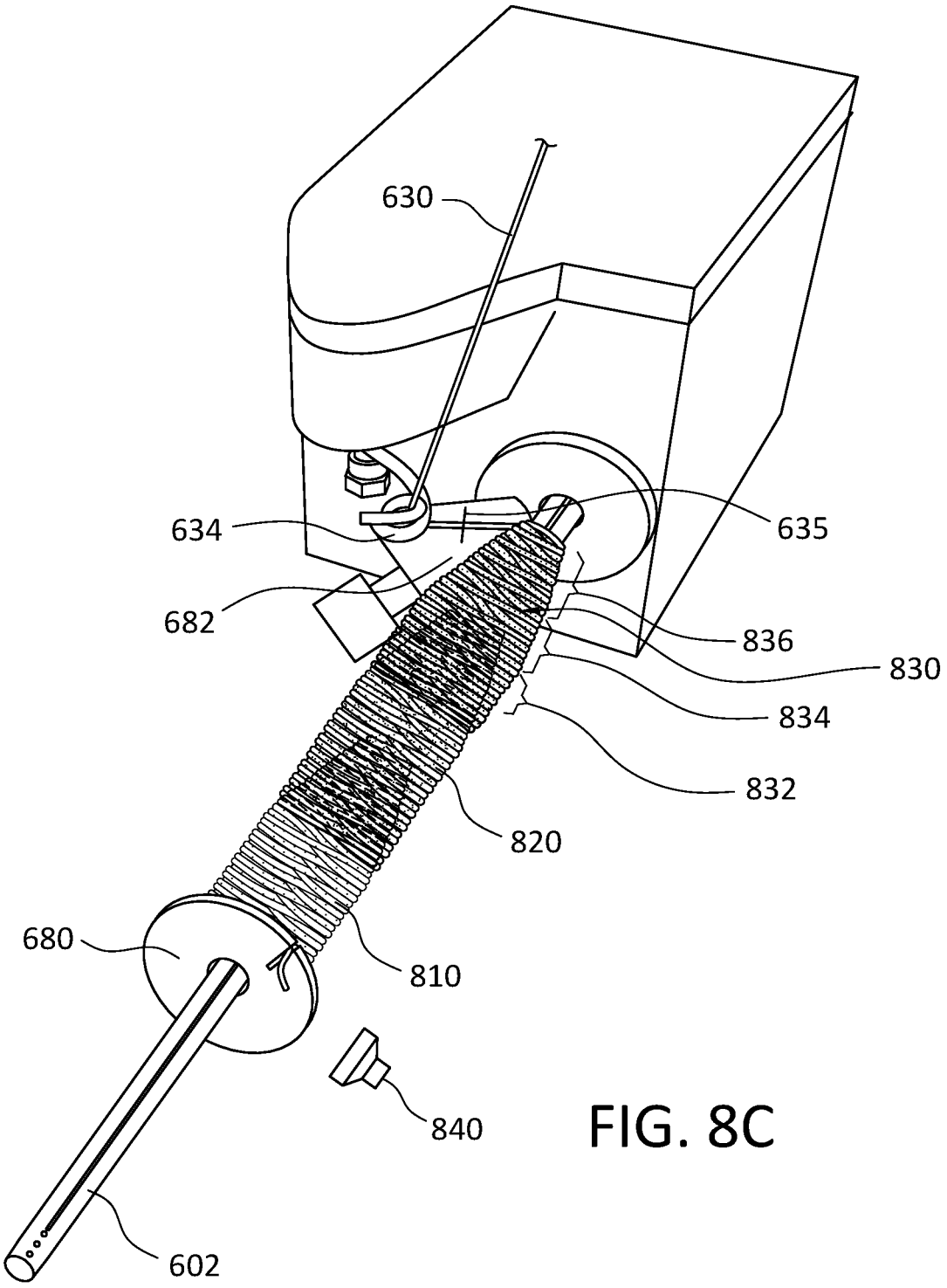
FIG. 8C is a schematic illustration of spindle showing the buildup of three segments in accordance with one embodiment of the invention.

FIGS. 8A-8C illustrate the buildup of the tubular winding 800 according to the methods described herein. In FIG. 8A a first segment 810 is built up having one colour shade on the spindle 602. The first fibre end 632 is held in the slit 684 of the support disc 680. First segment 810 has an end region 812, base region 814, and tip region 816. Each region comprises multiple partially overlapping loops of fibre 630 around core material 670 formed by the back and forth movement of the tension guide 620. The regions lack defining boundaries and generally have the following features. The end region 812 comprises the first fibre end 632 and when assembled into the tubular winding 800 may abut an opposing end region. When being built up end region 812 also contacts support disc 680. The diameter of first segment 810 builds until the fibres contact pusher 682. Pusher 682 has a conical-like shape to buildup a tapering shape in the tip region 816. Base region 814 represents the portion of the segment that will be primarily viewable by a user when in a curved shaped. In one embodiment, the base region 814 encompasses the maximum diameter for the first segment 810. Tip region 816 may be tapered having a diameter that is smaller than the base region 814 and will be interconnected with an adjacent segment.

FIG. 8B shows the continuing building of the tubular winding 800 by having a second segment 820 wound onto the tip region 816 of the first segment. As shown in FIG. 8B, support disc 680 is moved toward the opposing end 612 of spindle 602 as the second segment 820 is built up. In this embodiment, the segments are defined by contrasting colour shades. The fibre 630 is a continuous fibre between the first 810 and second segments 820. Second segment 820 comprises an overlapping region 822, base region 824 and tip region 826. Each region comprises multiple partially overlapping loops of fibre 630 around core material 670. Similar to the first segment, the regions lack defining boundaries and generally have the following features. Base region 824 and tip region 826 of the second segment 820 are similar in nature to the corresponding regions in the first segment 810. Overlapping region 822 is wound onto the tip region 816 of the first segment 810. To maintain a uniform appearance the combination of the overlapping region 822 and tip region 816 has a diameter that approximates the base region of either segment. This creates the interlocking configuration between the first segment 810 and second segment 820. When the segments are pulled apart the overlapping region 822 may have a carved out interior having the opposing taper of the tip region 816. As noted, in some cases, the tubular winding 800 comprises more than two segments, and thus, the process may repeat and buildup several interlocking second segments, where the overlapping region is built on the tip region of the adjacent segment. Thus, any subsequently formed segment may be separable from the interlocked adjacent segment.

For purposes of illustration FIG. 8C is a tubular winding 800 having a first segment 810, second segment 820 and third segment 830. The third segment 830 comprises the second fibre end 634 which may be formed at cut line 635. In some embodiments the second fibre end 634 may be cut. The second fibre end 634 may be tucked into the loops or may be free. Similar to the other segments third segment 830 comprises an overlapping region 832 that winds around and builds on the tip region of the segment, base region 834 and end region 836. Base region 824 and overlapping region 832 of the third segment 830 are similar in nature to the corresponding regions in the other segments. As shown in FIG. 8C there is a detector 840 which detects when support disc 680 is present indicating that the tubular winding is sufficiently built up. This stops the spindle rotation. The first fibre end 634 may be removed from the slit 684. Support disc 680 is removed from spindle 102 to allow the tubular winding to be withdrawn. Once the tubular winding 800 is withdrawn from the spindle, the end region 836 will abut the end region 812 of the first segment in a curved shape. The core material 670 may be connected to maintain its shape. In the third segment 830, the end region 836 may be less tapered than a tip region, but may have slight tapering. This interlocking configuration provides for some of the structural benefits described herein.

As noted above, this combination of the particular motion of the fibre feed along with axial guidance/motion of the fibre feed provides for improved structurally integrity for the tubular windings.

In some embodiments, the fibre may build on a tube. The tube may be a hollow cylinder, solid cylinder, cone, bobbin, or suitable construction. Preferably the tube is construction of a material that has some flexibility such as a paper board material or plastic material. In one embodiment, a hollow tube is positioned around a spindle and the winding method comprises attaching the first fibre end to the tube. The tube may be fitted to the spindle or secured to the spindle via a clamp, brace or suitable means. This allows the tube to rotate with the spindle to avoid slipping and causing the fibres to unwind. In this embodiment the tube may define the interior of the tubular winding and the first fibre end may be secured to the tube or may be removably attached to allow the user to remove the fibre when in use. The method further comprises the steps of rotating the tube and winding the fibre length onto the tube to build up the tubular winding. The method may use the overlapping back and forth motion and/or support disc. More details of the aforementioned methods are provided below.

Each of these general methods disclosed herein allows the buildup of a tubular winding that comprise multiple segments, e.g., a first segment and a second segment. The segments comprise fibre wound in a particular configuration, e.g., as a result of the aforementioned winding methods. The configured fibre(s) form the respective segment. The windings are discussed in more detail below.

As another example, the predetermined rate may include a motion portion and an intermittent pause portion. During the motion portion, the fibre is fed to the spindle as the feed moves axially (over the length of the full motion). During the pause portion, the fibre is fed to the spindle as the feed is stopped, which allows for the buildup of loops.

Segments

As noted above, the winding forms one or more segments, e.g., a first segment, having a tapered tip, e.g., a first tapered tip. Each of the one or more segments has a fibre parameter, such as type of fibre material, fibre diameter, and/or colour of fibre. In one embodiment, the (first) segment is made from or comprises a (first) colour composition. The winding also forms a second segment having a second tapered tip and that is made from or comprises a second colour composition and defines a second opening. The first tapered tip may be disposed at least partially inside the second opening to interlock the first and second segments, as discussed below.

The segments may be formed by winding the fibre around the axis of the spindle and/or around the core to create (multiple) loops. The configuration of the multiple loops forms the shape features of the segments, e.g., the tapered tip and the opening. For example, to form the tapered tip, the tip base may have more loops, which may be layered upon one another to create thickness, while the tip end may have fewer loops layered upon one another, which creates less thickness and provides for the aforementioned taper. Conventional skeins and/or balls, simply wrap fibres in random and/or overlapping patterns and do not contemplate the disclosed structural features nor the importance thereof. In some cases, the loops are not truly closed loops per se, but are formed by winding the fibre around a spindle.

A segment, in some cases, has a portion that is tapered, e.g., a tapered tip, which may comprise a tip base and a tip end tapering from base to end. In some cases, the tip is generally angled or conical, however, the term broadly includes other shapes having a tapered portion. In some embodiments the shape may taper from base to end. In some embodiments, the shape may taper at either the base or end, or both. For example, the tapered tip may be shaped such that the cross section of the base of the tip is larger than the cross section of the end of the tip. In some cases the tapered tip has generally circular cross sections to form a conical or cylinder shape. However, other shaped cross sections having sharp edges may be contemplated, e.g., square or rectangular, which may result in a pyramid shaped tip. In some embodiments, the tapered portion is positioned at an end of the segment. In some cases, the segments at the end of the tubular winding may have tapered portion on both ends of the segment while other segments in the middle of the tubular winding have a tapered portion on only one end. In some embodiments, the tapered shape results from the configuration of the looping of fibre in a segment. For example, less looping at one end allows the average diameter to be smaller. As the looping increases, the average diameter becomes larger, which results in the tapered shape.

Each segment may define its respective opening, extending from the base of the segment toward the tip end. The opening may not extend completely to the tip end. In some cases, the opening may only extend a portion of the way. The shape of the opening may vary widely. But, in some embodiments, the shape of the opening may be similar to the shape of the tapered tip, so as to receive it. The tapered tip of the following segment may be disposed/configured at least partially inside the opening of the leading segment. Stated another way, in some embodiments, the tapered portion may extend into an adjacent segment. As one example, the second segment may define a second opening and the first tapered tip may be disposed at least partially inside the second opening. Beneficially, this interlocking configuration provides for the aforementioned improvements in both structural integrity and colour separation. The description segments is applicable to the configuration of (adjacent) segments generally, not only to the first and second segments.

In some embodiments, the tubular winding comprises one or more segments, e.g., greater than 1, greater than 2, greater than 3, greater than 5, greater than 7, or greater than 10, and at least some of these segments interlock. In such cases, the multiple segments are connected by a core material or similar connector. In some cases the connector is a non-wrapped segment of fibre. Such a configuration results in multiple segments connected without being interlocked with one another, similar to a collection of sausages. These configurations demonstrate the aforementioned tangle-free and colour advantages discussed herein.

The tapering may result from the guidance of the fibre feed. In particular the combination of particular back and forth guidance/motion along with axial guidance/motion. As the specific axial guidance is provided, the winding and the back and forth feed lead to build up as the axial movement proceeds. The loops of fibre build upon one another, e.g., as discussed above. And the quantity of the layered loops establishes the thickness variance, e.g., tapering.

In some embodiments, the predetermined rate of the axial motion is employed to form the aforementioned segments. The predetermined rate may be configured to control the length of the segments and the taper of the respective tips. As one example, the predetermined rated may be a mostly continuous movement adjusted between discrete motions to help the loop buildup, and this mostly continuous movement may be based on the desired fibre thickness, colour segments, and/or overall tension requirements.

Segments/Colour Play

In traditional skeins or balls, when a consumer wants to rearrange the order of the shades wound one on top of each other in a multi-coloured skein, he or she can only re-wind the fibre in the opposite order or rewind the skein into multiple colour balls. For example, if the original colour order of a skein is red, orange, yellow, green and blue, rewinding the fibre to be blue, green, yellow, orange and red gives limited flexibility and is time consuming and increases the risk of tangling the fibre during the rewinding process. When consumers purchase longer striping fibres, they will cut each colour from the skein/cake fibres and wind each shade separately. It is very time consuming to wind each shade from the skein/cake and increases the risk of tangles.

These disadvantages are overcome by the colour play ability of the novel tubular windings described herein. Accordingly, one exemplary embodiment's multi-colour tubular windings can be wound by consecutively winding the different fibre colours/shades, as disclosed herein. At the transition of each colour/shade the end of the fibre of the previous colour is attached to the beginning of the fibre of the next colour. The fibre at the colour transition can be joined by any suitable attachment/fastening process known in the fibre manufacturing arts, including for example, tying, weaving, splicing, taping, gluing. In addition, to winding fibres of different colour or shade, fibres of different type and/or diameter may be found into a single tubular winding. In some cases, aper se connector may not be employed, and the colour/shade difference may be provided by the fibre being dyed a different colour. The different colour dye provides for the colour transition.

In addition, rather than consecutively winding the different coloured fibres along the axial direction of the spindle, the different colours can be consecutively wound in layers around a circumference of the spindle.

The tubular winding may have a first end (the base of the first segment) and a second end (the tip end of the last segment). The tubular winding may also have the first segment and a last segment the segment farthest (axially) from the first segment with multiple segments therebetween. In some embodiments, the tubular winding may comprise two segments, and in such situations the second segment is the last segment. Thus, the winding forms the tubular winding comprising multiple segments each having a respective colour composition and being configured between the first and second ends of the tubular winding. In some embodiments, the tubular winding may further a third segment having a third tapered tip, defining a third opening, and made from a third colour composition. As described above, the second tapered tip may be disposed at least partially inside the third opening. As more segments are added, the advantages of the ability to clearly display all of the colours of the tubular winding become more and more evident.

Each segment, in some cases, comprises or is made from a respective colour composition (the coloured features are discussed in more detail below). In some embodiments, the segments may have a pattern of repeating colours. The differing colours conveniently allow for clear visual and simple definition/delineation of the multiple segments. Colour compositions generally include the fibre and a colour component, e.g., a dye, or another additive or treatment that provides the respective colour to the segment. The colour compositions themselves may vary widely, and methods for colouring, e.g., dyeing, fibres, are well known. In one embodiment, the use of the multiple segments, each made of a different colour composition (and thus having a different colour) form a multi-coloured tubular winding. As noted above, because of the different coloured segments, the aforementioned colour-related benefits and advantages are realized, e.g., the ability of a consumer to see all of the colours of the tubular winding and/or the actual quantities of the respective colours, as well as the enhanced aesthetics of the resultant packaging.

In some embodiments, the segments differ from one another for reason other than colour. Such fibre differentiations are well known, and include, but are not limited to fibre gauge, diameter, shade, material, finish, etc. At the transition of each differentiation, the differing segments may be connected by fixing the end of a lead fibre with the beginning end of a following fibre. This may be achieved by many methods, including, but not limited to, knotting, splicing, weaving, gluing, mechanically connecting or taping the ends of the adjacent fibres.

In some embodiments, the segments for use per project by the consumer and do not necessarily differ in colour. This allows the consume to readily and easily separate and carry the amount of fibre needed for the project. The segments, however, may still have the structural features described herein, which provide for the aforementioned structural benefits.

In some embodiments, each segment is essentially separable from its adjacent segment, but may be built from a continuous fibre. The two adjacent segments, upon separation, yield two separated segments each of which is visually delineated by its colour composition. As such, the problems associated with re-working and separating conventional skeins to arrive at multiple bunches of fibre, are advantageously reduced or eliminated. The separating may be achieved by any suitable means, one simply yet practical example of which is by pulling the two segments apart by hand. Essentially separable means that two segments are not intertwined with one another. A connecting segment of fibre may exist, but that connecting portion is minimal (and may easily be snipped to arrive at two unconnected segments). For example, the second segment may comprise or may encapture, less than 50% of the first colour composition, e.g., less than 40%, less than 30%, less than 20%, less than 10% or less than 5%. These limits are applicable to segments generally, not only to the first and second segments. As one example, in the case of adjacent first and second segments, upon separation of the first and second segments, less than 50% of the first colour composition is present in the separated second segment and vice versa—a clear distinction between the two segments is evident.

Curved Shape

In some embodiments, the ends of the tubular windings (the first and second ends of the tubular winding) are connected to form a continuous tubular winding, e.g., having a curved shape, such as for example a substantially circular shape or ring shape. Substantially circular shape refers shape having a portion curved on an arc of a circle and may have ends that are open. The method may include the step of connecting the ends of the core (the first and second ends of the core) to one another to provide the continuous tubular winding. The tubular winding, collectively, may have a first end (the base of the first segment) and a second end (the tip end of the last segment). In some embodiments, there will be multiple segments between the first end and the second end. Unlike conventional skeins or balls, which are not continuous in shape and do not have connected ends or any true ends at all, the curved-shape of the continuous tubular windings provides for the aesthetic, structural, and display benefits described above, e.g., the ability to be hung or positioned without the need for further retail packaging. Both continuous (ring-shaped) and non-continuous (tube-shaped) tubular windings are contemplated by the present disclosure.

In some cases, when a core material is employed, the ends of the core (the first and second ends of the core material) may be connected to one another to hold the continuous tubular winding in a curved shape.

Figure 9:
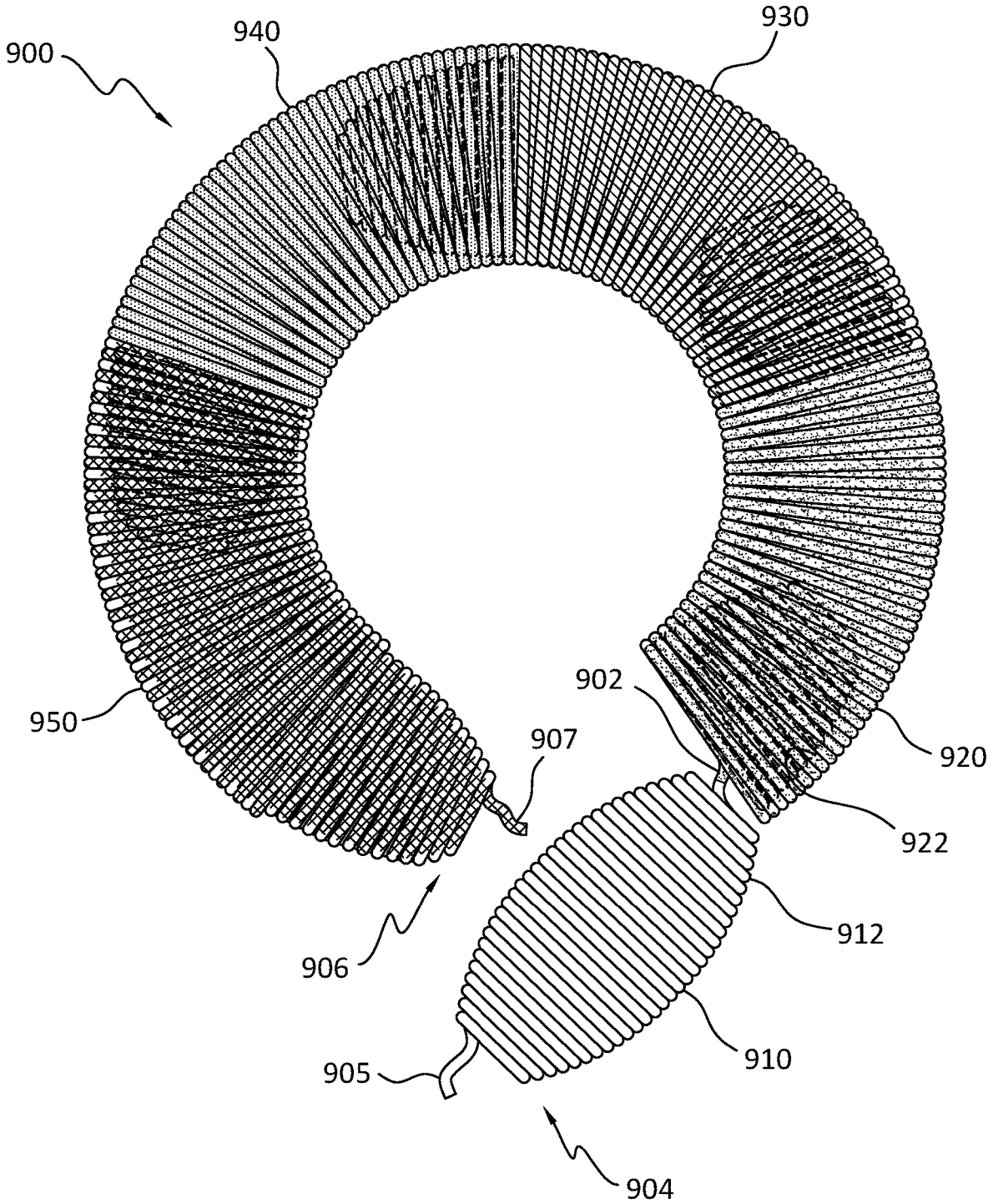
FIG. 9 a tubular winding having multiple segments configured in a curved shape in accordance with one embodiment of the invention.

FIG. 9 shows a tubular winding 900 comprising multiple segments 910, 920, 930, 940, and 950 bent to form a curved shape. Segment 910 has tapered tip region 912, which may be configured to fit inside of opening 922 of segment 920. For purposes of illustration segment 910 is pulled apart from segment 920, but the continuous fibre 902 connects the two segments. FIG. 9 demonstrates the advantageous aspect of the segments being easily separable so that segment 910 is separable from segment 920, segment 920 is separable from segment 930, segment 930 is separable from segment 940, and segment 940 is separable from segment 950. This allows the consumer to readily access one segment for use without having to rework the tubular winding 900. Each segments 910, 920, 930, 940, and 950 may differ from one another, for example in colour or in diameter of the fibre from which the respective segments are made. Tubular winding 900 has first end 904 with a first fibre end 905 and second end 906 with the a second fibre end 907. In one embodiment, the fibre ends 905, 907 are not connected so that the consumer can withdraw the fibre in a tangle free manner. In one embodiment, the fibre ends 905, 907 may be connected as a continuous fibre or knotted together and the consumer may free both ends.

EMBODIMENTS

The following embodiments are contemplated. All combinations of features and embodiments are contemplated.

Embodiment 1 is a A method of building up fibre to a tubular winding having two or more segments having an interlocking configuration, comprising the steps of attaching first fibre end of the fibre to a spindle through a tension guide; rotating the spindle in a fixed plane around an axis; moving the tension guide in a back and forth direction, wherein a throw of the back and forth direction is less than the length of at least one of the two or more segments; and moving the tension guide in a longitudinal direction from one end of the spindle to the opposing end of the spindle, wherein at least a portion of one segment overlaps with at least a portion of another segment, and wherein at least two segments have a fibre parameter that is different.

Embodiment 2 is an embodiment of embodiment 1, wherein the tubular winding comprises up to three segments.

Embodiment 3 is an embodiment of embodiment 1, wherein the tubular winding comprises up to five segments.

Embodiment 4 is an embodiment of embodiment 1, wherein the tubular winding comprises up to six segments.

Embodiment 5 is an embodiment of embodiment 1, wherein the tubular winding comprises up to ten segments.

Embodiment 6 is an embodiment of embodiment 1, wherein the tubular winding comprises up to twelve segments.

Embodiment 7 is an embodiment of any one of embodiments 1-6, wherein the at least one fibre parameter is a type of fibre material, fibre diameter, or colour of fibre.

Embodiment 8 is an embodiment of embodiment 7, wherein the colour of fibre includes shades of colour and/or contrasting colours.

Embodiment 9 is an embodiment of any one of embodiments 1-8, further comprising controlling the rotation of the spindle and/or movement of the tension guide based on one of the at least one fibre parameter.

Embodiment 10 is an embodiment of any one of embodiments 1-9, wherein the throw of the back and forth direction is substantially constant.

Embodiment 11 is an embodiment of any one of embodiments 1-9, wherein the throw of the back and forth direction is increased in one direction.

Embodiment 12 is an embodiment of any one of embodiments 1-11, wherein the movement of the tension guide is substantially constant.

Embodiment 13 is an embodiment of any one of embodiments 1-11, wherein the movement of the tension guide is variable.

Embodiment 14 is an embodiment of any one of embodiments 1-13, wherein the longitudinal direction is substantially parallel to the axis.

Embodiment 15 is an embodiment of any one of embodiments 1-14, wherein the fibre is continuous and has differently colour portions.

Embodiment 16 is an embodiment of any one of embodiments 1-15, further comprising attaching a core material having opposing ends to both end regions of the spindle; removing the tubular winding together the core material from the spindle; and connecting the opposing ends of the core material to form the tubular winding into a curved shape.

Embodiment 17 is an embodiment of embodiment 16, wherein the core material is a transparent thermoplastic.

Embodiment 18 is a method of building up fibre to a tubular winding having two or more segments having an interlocking manner, comprising the steps of: attaching first fibre end of the fibre to a support disc on a spindle through a tension guide; rotating the spindle in a fixed plane around an axis; moving the tension guide in a back and forth direction, wherein the throw of the back and forth direction is less than the length of at least one of the two or more segments; and moving the support disc in a longitudinal direction from one end of the spindle to the opposing end of the spindle, wherein at least a portion of the two or more segments overlaps each other and wherein the two or more segment have at least one fibre parameter that is different.

Embodiment 19 is an embodiment of embodiment 18, wherein the tubular winding comprises up to three segments.

Embodiment 20 is an embodiment of embodiment 18, wherein the tubular winding comprises up to five segments.

Embodiment 21 is an embodiment of embodiment 18, wherein the tubular winding comprises up to six segments.

Embodiment 22 is an embodiment of embodiment 18, wherein the tubular winding comprises up to ten segments.

Embodiment 23 is an embodiment of embodiment 18, wherein the tubular winding comprises up to twelve segments.

Embodiment 24 is an embodiment of any one of embodiments 18-23, wherein the at least one fibre parameter is a type of fibre material, fibre diameter, or colour of fibre.

Embodiment 25 is an embodiment of embodiment 24, wherein the colour of fibre includes shades of colour and/or contrasting colours.

Embodiment 26 is an embodiment of any one of embodiments 18-25, further comprising controlling the rotation of the spindle and/or movement of the tension guide or support disc based on one of the at least one fibre parameter.

Embodiment 27 is an embodiment of any one of embodiments 18-26, wherein the throw of the back and forth direction is substantially constant.

Embodiment 28 is an embodiment of any one of embodiments 18-26, wherein the throw of the back and forth direction is increased in one direction.

Embodiment 29 is an embodiment of any one of embodiments 18-28, wherein the movement of the support disc is substantially constant.

Embodiment 30 is an embodiment of any one of embodiments 18-28, wherein the movement of the support disc is variable.

Embodiment 31 is an embodiment of any one of embodiments 18-30, wherein the fibre is continuous and has differently colour portions.

Embodiment 32 is an embodiment of any one of embodiments 18-31, further comprising attaching a core material having opposing ends to both end regions of the spindle; removing the tubular winding together the core material from the spindle; and connecting the opposing ends of the core material to form the tubular winding into a curved shape.

Embodiment 33 is an embodiment of embodiment 32, wherein the core material is a transparent thermoplastic.

Embodiment 34 is a tubular winding comprising a fibre comprising a first portion having a first fibre parameter and second portion having a second fibre parameter, wherein the first fibre parameter is different from the second fibre parameter, a first segment comprising the first portion, wherein the first segment comprises a first end region, first base region and a first tip region; and a second segment comprising the second portion, wherein the second segment comprises a second overlapping region, second base region and a second tip region, wherein the second overlapping region covers at least 75% of the first tip region to position the second base region adjacent to the first base region and wherein both the first base region and the second base region are visible.

Embodiment 35 is an embodiment of embodiment 34, wherein the tubular winding comprises up to three segments.

Embodiment 36 is an embodiment of embodiment 34, wherein the tubular winding comprises up to five segments.

Embodiment 37 is an embodiment of embodiment 34, wherein the tubular winding comprises up to six segments.

Embodiment 38 is an embodiment of embodiment 34, wherein the tubular winding comprises up to ten segments.

Embodiment 39 is an embodiment of embodiment 34, wherein the tubular winding comprises up to twelve segments.

Embodiment 40 is an embodiment of any one of embodiments 34-39, wherein the first and second fibre parameters comprise a type of fibre material, fibre diameter, or colour of fibre, provided that the first and second fibre parameters are different.

Embodiment 41 is an embodiment of any one of embodiments 34-40, wherein the first base region has a diameter that is larger than the first end region or the first tip region.

Embodiment 42 is an embodiment of any one of embodiments 34-41, wherein the second base region has a diameter that is larger than the second end region or the second tip region.

Embodiment 43 is an embodiment of any one of embodiments 34-42, wherein the first tip region is tapered.

Embodiment 44 is an embodiment of any one of embodiments 34-43, wherein the second tip region is tapered.

Embodiment 45 is an embodiment of any one of embodiments 34-44, wherein the first and second segments are separable.

Embodiment 46 is an embodiment of any one of embodiments 34-45, further comprising a third segment comprising the third portion having a third fibre parameter that is different from either the first fibre parameter or second fibre parameter, wherein the third segment comprises a third overlapping region, third base region and a third end region, wherein the third overlapping region covers at least 75% of the second tip region to position the third base region adjacent to the second base region and wherein both the second base region and the third base region are visible.

Embodiment 47 is an embodiment of embodiment 46, wherein the first end region of the first segment abut the third end region of the third segment.

Embodiment 48 is an embodiment of embodiment 46, wherein the second and the third segments are separable.

Embodiment 49 is an embodiment of any one of embodiments 34-48, further comprising a core material having two ends wherein the first segment and second segment are wound around the core material.

Embodiment 50 is an embodiment of any one of embodiments 34-49, wherein the ends of the core material are connected to shape the tubular winding into a curved shape.

In some embodiments, any or some of the steps or components disclosed herein may be considered optional. In some cases, any or some of the aforementioned items in this description may expressly excluded, e.g., via claim language. For example claim language may be modified to recite that the disclosed method, etc., do not utilize or comprise a wrapper application step.

As used herein, "greater than" and "less than" limits may also include the number associated therewith. Stated another way, "greater than" and "less than" may be interpreted as "greater than or equal to" and "less than or equal to." It is contemplated that this language may be subsequently modified in the claims to include "or equal to." For example, "greater than 4.0" may be interpreted as, and subsequently modified in the claims as "greater than or equal to 4.0."

While the disclosure has been described in detail, modifications within the spirit and scope of the disclosure will be readily apparent to those of skill in the art. In view of the foregoing discussion, relevant knowledge in the art and references discussed above in connection with the Background and Detailed Description, the disclosures of which are all incorporated herein by reference. In addition, it should be understood that aspects of the disclosure and portions of various embodiments and various features recited below and/or in the appended claims may be combined or interchanged either in whole or in part. In the foregoing descriptions of the various embodiments, those embodiments which refer to another embodiment may be appropriately combined with other embodiments as will be appreciated by one of skill in the art. Furthermore, those of ordinary skill in the art will appreciate that the foregoing description is by way of example only, and is not intended to limit the disclosure.

What is claimed is:

1. A method of building up fibre to a tubular winding having two or more segments having an interlocking configuration, comprising the steps of:

attaching first fibre end of the fibre to a spindle through a tension guide;

rotating the spindle in a fixed plane around an axis;

moving the tension guide in a back and forth direction, wherein a throw of the back and forth direction is less than the length of at least one of the two or more segments; and moving the tension guide in a longitudinal direction from one end of the spindle to the opposing end of the spindle, wherein at least a portion of one segment overlaps with at least a portion of another segment, and wherein at least two segments have a fibre parameter that is different.

2. The method of claim 1, wherein the at least one fibre parameter is a type of fibre material, fibre diameter, or colour of fibre.

3. The method of claim 1, further comprising:

controlling the rotation of the spindle and/or movement of the tension guide based on one of the at least one fibre parameter.

4. The method of claim 1, wherein the throw of the back and forth direction is substantially constant.

5. The method of claim 1, wherein the movement of the tension guide is substantially constant.

6. The method of claim 1, wherein the longitudinal direction is substantially parallel to the axis.

7. The method of claim 1, wherein the fibre is continuous and has differently colour portions.

8. The method of claim 1, further comprising attaching a core material having opposing ends to both end regions of the spindle;

removing the tubular winding together the core material from the spindle; and connecting the opposing ends of the core material to form the tubular winding into a curved shape.

9. A method of building up fibre to a tubular winding having two or more segments having an interlocking manner, comprising the steps of:

attaching first fibre end of the fibre to a support disc on a spindle through a tension guide;

rotating the spindle in a fixed plane around an axis;

moving the tension guide in a back and forth direction, wherein the throw of the back and forth direction is less than the length of at least one of the two or more segments; and moving the support disc in a longitudinal direction from one end of the spindle to the opposing end of the spindle, wherein at least a portion of the two or more segments overlaps each other and wherein the two or more segment have at least one fibre parameter that is different.

10. The method of claim 9, further comprising attaching a core material having opposing ends to both end regions of the spindle;

removing the tubular winding and the core material from the spindle; and connecting the opposing ends of the core material to form the tubular winding into a curved shape.

11. A tubular winding comprising:

a fibre comprising a first portion having a first fibre parameter and second portion having a second fibre parameter, wherein the first fibre parameter is different from the second fibre parameter;

a first segment comprising the first portion, wherein the first segment comprises a first end region, first base region and a first tip region; and a second segment comprising the second portion, wherein the second segment comprises a second overlapping region, second base region and a second tip region, wherein the second overlapping region covers at least 75% of the first tip region to position the second base region adjacent to the first base region and wherein both the first base region and the second base region are visible.

12. The tubular winding of claim 11, wherein the first and second fibre parameters comprise a type of fibre material, fibre diameter, or colour of fibre.

13. The tubular winding of claim 11, wherein the first base region has a diameter that is larger than the first end region or the first tip region or wherein the second base region has a diameter that is larger than the second end region or the second tip region.

14. The tubular winding of claim 11, wherein the first tip region or second tip region is tapered.

15. The tubular winding of claim 11, wherein the first and second segments are separable.

16. The tubular winding of claim 11, further comprising:

a third segment comprising the third portion having a third fibre parameter that is different from either the first fibre parameter or second fibre parameter, wherein the third segment comprises a third overlapping region, third base region and a third end region, wherein the third overlapping region covers at least 75% of the second tip region to position the third base region adjacent to the second base region and wherein both the second base region and the third base region are visible.

17. The tubular winding of claim 16, further comprising a core material wherein the first segment and second segment are wound around the core material.

18. The tubular winding of claim 17, wherein the ends of the core material are connected to shape the tubular winding into a curved shape.

19. The tubular winding of claim 18, wherein the first end region of the first segment abut the third end region of the third segment.

20. The tubular winding of claim 16, wherein the second and the third segments are separable.

* * * * *